US008175494B2

(12) United States Patent
Kaneyama et al.

(10) Patent No.: US 8,175,494 B2
(45) Date of Patent: May 8, 2012

(54) INTERMEDIATE TRANSFER DEVICE, TRANSFER DEVICE AND IMAGE FORMING APPARATUS FOR WRINKLE SUPPRESSION

(75) Inventors: Kiyotoshi Kaneyama, Kanagawa (JP); Tadakazu Edure, Tokyo (JP); Kazutoshi Sugitani, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 394 days.

(21) Appl. No.: 12/542,370

(22) Filed: Aug. 17, 2009

(65) Prior Publication Data

US 2010/0247144 A1 Sep. 30, 2010

(30) Foreign Application Priority Data

Mar. 27, 2009 (JP) ..... P2009-078266

(51) Int. Cl.
*G03G 15/01* (2006.01)
*G03G 15/16* (2006.01)

(52) U.S. Cl. ..... 399/121; 399/299; 399/302

(58) Field of Classification Search ..... 399/121, 399/298, 299, 302
See application file for complete search history.

(56) References Cited

U.S. PATENT DOCUMENTS

| | | | | |
|---|---|---|---|---|
| 6,044,244 | A | 3/2000 | Watanabe et al. | 399/313 |
| 6,934,497 | B2 * | 8/2005 | Hagiwara et al. | 399/299 |
| 7,567,775 | B2 * | 7/2009 | Fukuhara | 399/302 |

FOREIGN PATENT DOCUMENTS

| | | |
|---|---|---|
| JP | 06-324575 | 11/1994 |
| JP | 10-26846 | 1/1998 |
| JP | 11-38796 | 2/1999 |
| JP | 2001-194932 | 7/2001 |
| JP | 2002-091185 | 3/2002 |
| JP | 2008-139749 | 6/2008 |
| JP | 2008-233196 | 10/2008 |

* cited by examiner

*Primary Examiner* — William J Royer
(74) *Attorney, Agent, or Firm* — Morgan, Lewis & Bockius LLP

(57) ABSTRACT

An intermediate transfer device includes an endless-belt-form intermediate transfer material; a first moving member that is movable between a first position-1 and a second position-1, which is farther from the intermediate transfer material than the first position-1; a second moving member that is movable between a first position-2 and a second position-2, which is farther from the intermediate transfer material than the first position-2; a first tension applying member; a second tension applying member; and a third tension applying member that applies tension to the intermediate transfer material when at least either the first moving member is moved to the second position-1 or the second moving member is moved to the second position-2, and that is separated from the intermediate transfer material when the first moving member is in the first position-1 and the second moving member is in the first position-2.

6 Claims, 13 Drawing Sheets

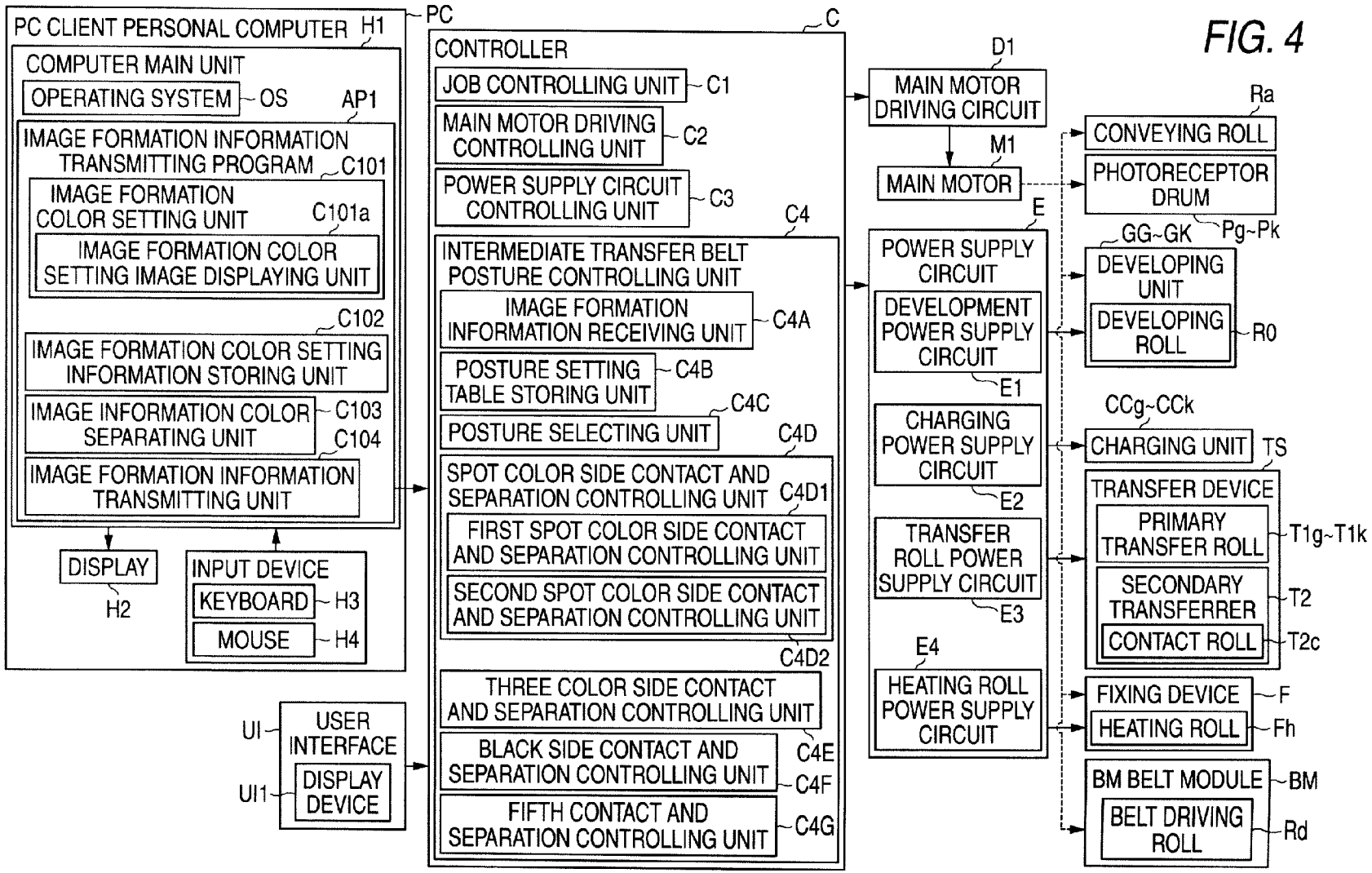
FIG. 4
PC
PC CLIENT PERSONAL COMPUTER H1
COMPUTER MAIN UNIT
OPERATING SYSTEM OS
AP1
IMAGE FORMATION INFORMATION TRANSMITTING PROGRAM C101
IMAGE FORMATION COLOR SETTING UNIT C101a
IMAGE FORMATION COLOR SETTING IMAGE DISPLAYING UNIT
C102
IMAGE FORMATION COLOR SETTING INFORMATION STORING UNIT
C103
IMAGE INFORMATION COLOR SEPARATING UNIT
C104
IMAGE FORMATION INFORMATION TRANSMITTING UNIT
DISPLAY H2
INPUT DEVICE
KEYBOARD H3
MOUSE H4
UI
USER INTERFACE
UI1
DISPLAY DEVICE
C
CONTROLLER
C1
JOB CONTROLLING UNIT
C2
MAIN MOTOR DRIVING CONTROLLING UNIT
C3
POWER SUPPLY CIRCUIT CONTROLLING UNIT
C4
INTERMEDIATE TRANSFER BELT POSTURE CONTROLLING UNIT
C4A
IMAGE FORMATION INFORMATION RECEIVING UNIT
C4B
POSTURE SETTING TABLE STORING UNIT
C4C
POSTURE SELECTING UNIT
C4D
SPOT COLOR SIDE CONTACT AND SEPARATION CONTROLLING UNIT
C4D1
FIRST SPOT COLOR SIDE CONTACT AND SEPARATION CONTROLLING UNIT
C4D2
SECOND SPOT COLOR SIDE CONTACT AND SEPARATION CONTROLLING UNIT
C4E
THREE COLOR SIDE CONTACT AND SEPARATION CONTROLLING UNIT
C4F
BLACK SIDE CONTACT AND SEPARATION CONTROLLING UNIT
C4G
FIFTH CONTACT AND SEPARATION CONTROLLING UNIT
D1
MAIN MOTOR DRIVING CIRCUIT
M1
MAIN MOTOR
E
POWER SUPPLY CIRCUIT
DEVELOPMENT POWER SUPPLY CIRCUIT
E1
CHARGING POWER SUPPLY CIRCUIT
E2
TRANSFER ROLL POWER SUPPLY CIRCUIT
E3
E4
HEATING ROLL POWER SUPPLY CIRCUIT
Ra
CONVEYING ROLL
PHOTORECEPTOR DRUM
Pg~Pk
GG~GK
DEVELOPING UNIT
R0
DEVELOPING ROLL
CCg~CCk
CHARGING UNIT
TS
TRANSFER DEVICE
T1g~T1k
PRIMARY TRANSFER ROLL
T2
SECONDARY TRANSFERRER
T2c
CONTACT ROLL
F
FIXING DEVICE
Fh
HEATING ROLL
BM
BM BELT MODULE
Rd
BELT DRIVING ROLL

FIG. 5

101

| | No. | NUMBER OF COLORS | IMAGE FORMATION COLOR | | | |
|---|---|---|---|---|---|---|
| | | | K (BLACK) | CMY (CYAN, MAGENTA, YELLOW) | O (ORANGE) | G (GREEN) |
| | ☑ 1 | 6 COLORS | ○ | ○ | ○ | ○ |
| 101a | ☐ 2 | 5 COLORS | ○ | ○ | | ○ |
| | ☐ 3 | 5 COLORS | ○ | ○ | ○ | |
| | ☐ 4 | 4 COLORS | ○ | ○ | | |
| 101a | ☐ 5 | 4 COLORS | | ○ | | ○ |
| | ☐ 6 | 4 COLORS | | ○ | ○ | |
| | ☐ 7 | 3 COLORS | | ○ | | |
| 101a | ☐ 8 | 2 COLORS | | | ○ | ○ |
| | ☐ 9 | 2 COLORS | ○ | | | ○ |
| | ☐ 10 | 2 COLORS | ○ | | ○ | |
| 101a | ☐ 11 | 1 COLOR | | | | ○ |
| | ☐ 12 | 1 COLOR | | | ○ | |
| | ☐ 13 | 1 COLOR | ○ | | | |
| 101a | ☐ 14 | 0 COLORS | | | | |

FIG. 6

POSTURE SETTING TABLE TB

| | RETRACTING ROLL POSITION | | | | |
|---|---|---|---|---|---|
| No. | R5 | R4 | R3 | R2 | R1 |
| 1 | UP | UP | UP | UP | UP |
| 2 | UP | UP | UP | DOWN | UP |
| 3 | UP | UP | UP | UP | DOWN |
| 4 | UP | UP | UP | DOWN | DOWN |
| 5 | DOWN | UP | UP | DOWN | UP |
| 6 | DOWN | UP | UP | UP | DOWN |
| 7 | DOWN | UP | UP | DOWN | DOWN |
| 8 | DOWN | DOWN | DOWN | UP | UP |
| 9 | UP | UP | DOWN | DOWN | UP |
| 10 | UP | UP | DOWN | UP | DOWN |
| 11 | DOWN | DOWN | DOWN | DOWN | UP |
| 12 | DOWN | DOWN | DOWN | UP | DOWN |
| 13 | UP | UP | DOWN | DOWN | DOWN |
| 14 | DOWN | DOWN | DOWN | DOWN | DOWN |

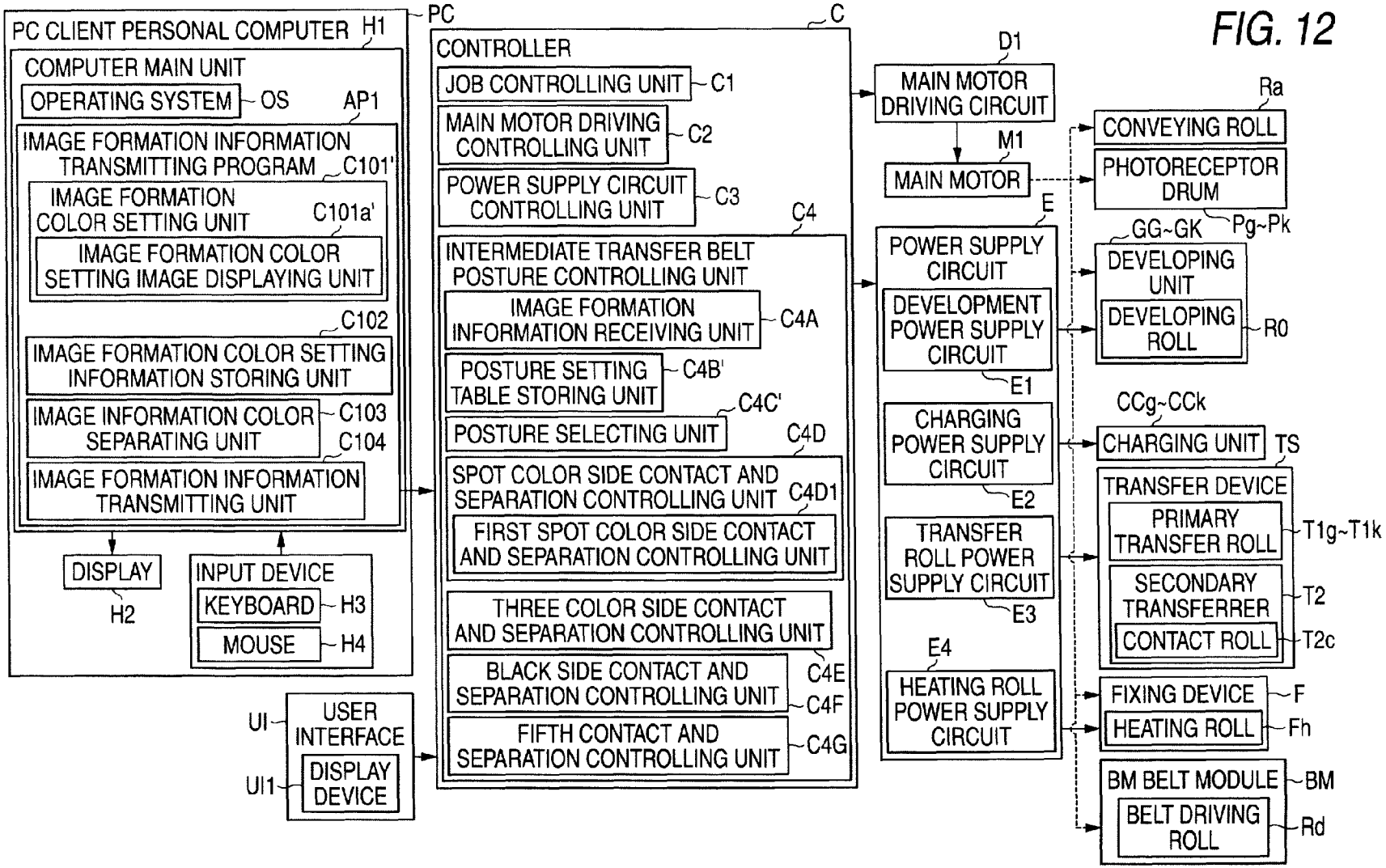
FIG. 12
PC CLIENT PERSONAL COMPUTER H1
COMPUTER MAIN UNIT
OPERATING SYSTEM OS
AP1
IMAGE FORMATION INFORMATION TRANSMITTING PROGRAM C101'
IMAGE FORMATION COLOR SETTING UNIT C101a'
IMAGE FORMATION COLOR SETTING IMAGE DISPLAYING UNIT
C102
IMAGE FORMATION COLOR SETTING INFORMATION STORING UNIT
C103
IMAGE INFORMATION COLOR SEPARATING UNIT
C104
IMAGE FORMATION INFORMATION TRANSMITTING UNIT
DISPLAY H2
INPUT DEVICE
KEYBOARD H3
MOUSE H4
PC
C
CONTROLLER
JOB CONTROLLING UNIT C1
MAIN MOTOR DRIVING CONTROLLING UNIT C2
POWER SUPPLY CIRCUIT CONTROLLING UNIT C3
C4
INTERMEDIATE TRANSFER BELT POSTURE CONTROLLING UNIT
IMAGE FORMATION INFORMATION RECEIVING UNIT C4A
POSTURE SETTING TABLE STORING UNIT C4B'
POSTURE SELECTING UNIT C4C'
SPOT COLOR SIDE CONTACT AND SEPARATION CONTROLLING UNIT C4D
FIRST SPOT COLOR SIDE CONTACT AND SEPARATION CONTROLLING UNIT C4D1
THREE COLOR SIDE CONTACT AND SEPARATION CONTROLLING UNIT C4E
BLACK SIDE CONTACT AND SEPARATION CONTROLLING UNIT C4F
FIFTH CONTACT AND SEPARATION CONTROLLING UNIT C4G
USER INTERFACE UI
DISPLAY DEVICE UI1
D1
MAIN MOTOR DRIVING CIRCUIT
M1
MAIN MOTOR
E
POWER SUPPLY CIRCUIT
DEVELOPMENT POWER SUPPLY CIRCUIT E1
CHARGING POWER SUPPLY CIRCUIT E2
TRANSFER ROLL POWER SUPPLY CIRCUIT E3
E4
HEATING ROLL POWER SUPPLY CIRCUIT
Ra
CONVEYING ROLL
PHOTORECEPTOR DRUM Pg~Pk
GG~GK
DEVELOPING UNIT R0
DEVELOPING ROLL
CCg~CCk
CHARGING UNIT TS
TRANSFER DEVICE T1g~T1k
PRIMARY TRANSFER ROLL
SECONDARY TRANSFERRER T2
CONTACT ROLL T2c
FIXING DEVICE F
HEATING ROLL Fh
BM BELT MODULE BM
BELT DRIVING ROLL Rd

FIG. 13

101′

| | | IMAGE FORMATION COLOR | | |
|---|---|---|---|---|
| No. | NUMBER OF COLORS | K (BLACK) | CMY (CYAN, MAGENTA, YELLOW) | G (GREEN) |
| ☑ 1 | 5 COLORS | ○ | ○ | ○ |
| ☐ 2 | 4 COLORS | ○ | ○ | |
| ☐ 3 | 4 COLORS | | ○ | ○ |
| ☐ 4 | 3 COLORS | | ○ | |
| ☐ 5 | 2 COLORS | ○ | | ○ |
| ☐ 6 | 1 COLOR | ○ | | |
| ☐ 7 | 1 COLOR | | | ○ |
| ☐ 8 | 0 COLORS | | | |

101a′ 101a′ 101a′

FIG. 14

POSTURE SETTING TABLE TB'

| | RETRACTING ROLL POSITION | | | |
|---|---|---|---|---|
| No. | R5 | R4 | R3 | R1 |
| 1 | UP | UP | UP | UP |
| 2 | UP | UP | UP | DOWN |
| 3 | DOWN | UP | UP | UP |
| 4 | DOWN | UP | UP | DOWN |
| 5 | UP | UP | DOWN | UP |
| 6 | UP | UP | DOWN | DOWN |
| 7 | DOWN | DOWN | DOWN | UP |
| 8 | DOWN | DOWN | DOWN | DOWN |

INTERMEDIATE TRANSFER DEVICE, TRANSFER DEVICE AND IMAGE FORMING APPARATUS FOR WRINKLE SUPPRESSION

CROSS-REFERENCE TO RELATED APPLICATIONS

This application is based on and claims priority under 35 USC 119 from Japanese Patent Application No. 2009-078266 filed on Mar. 27, 2009.

BACKGROUND

1. Technical Field

The present invention relates to an intermediate transfer device, a transfer device and an image forming apparatus.

2. Related Art

In image forming apparatuses such as electrophotographic copiers and printers, a visible image formed on a photoreceptor surface is primarily transferred onto an intermediate transfer material such as an intermediate transfer belt, secondarily transferred from the intermediate transfer material onto a medium and then, fixed thereon to form an image.

SUMMARY

A technical problem of the present invention is to suppress wrinkles caused on the intermediate transfer material as the condition of tension application to the intermediate transfer material is changed.

According to an aspect of the invention, there is provided an intermediate transfer device including an endless-belt-form intermediate transfer material whose outer surface successively passes, in a rotation direction, through regions where the outer surface is opposed to a first image holding member that holds a first image and a second image holding member that holds a second image; a first moving member that is disposed on a rear surface side of the intermediate transfer material and on a side of the first image holding member, and that is movable between a first position-1, where the first moving member applies tension to the intermediate transfer material, and a second position-1, which is farther from the intermediate transfer material than the first position-1; a second moving member that is disposed on the rear surface side of the intermediate transfer material and on a side of the second image holding member, and that is movable between a first position-2, where the second moving member applies tension to the intermediate transfer material, and a second position-2, which is farther from the intermediate transfer material than the first position-2; a first tension applying member that is disposed on an upstream side, in the rotation direction of the intermediate transfer material, of the first moving member and that applies tension to the intermediate transfer material; a second tension applying member that is disposed on a downstream side, in the rotation direction of the intermediate transfer material, of the second moving member and that applies tension to the intermediate transfer material; and a third tension applying member that is disposed on the rear surface side of the intermediate transfer material, and that applies tension to the intermediate transfer material when at least either the first moving member is moved to the second position-1 or the second moving member is moved to the second position-2, and that is separated from the intermediate transfer material when the first moving member is in the first position-1 and the second moving member is in the first position-2.

BRIEF DESCRIPTION OF THE DRAWINGS

Exemplary embodiment(s) of the present invention will be described in detail based on the following figures, wherein:

FIG. 4 is a block diagram showing the functions that a controller of the image forming apparatus of the first example of the present invention is provided with;

FIG. 5 is an explanatory view of an image formation color setting image of the first example of the present invention;

FIG. 6 is an explanatory view of a posture setting table of the first example of the present invention;

FIG. 12 is a block diagram, corresponding to FIG. 4 of the first example, showing the functions that a controller of an image forming apparatus of the second example of the present invention is provided with;

FIG. 13 is an explanatory view, corresponding to FIG. 5 of the first example, of the image formation color setting image of the second example of the present invention; and FIG. 14 is an explanatory view, corresponding to FIG. 6 of the first example, of a posture setting table of the second example of the present invention.

DETAILED DESCRIPTION

Figure 1:
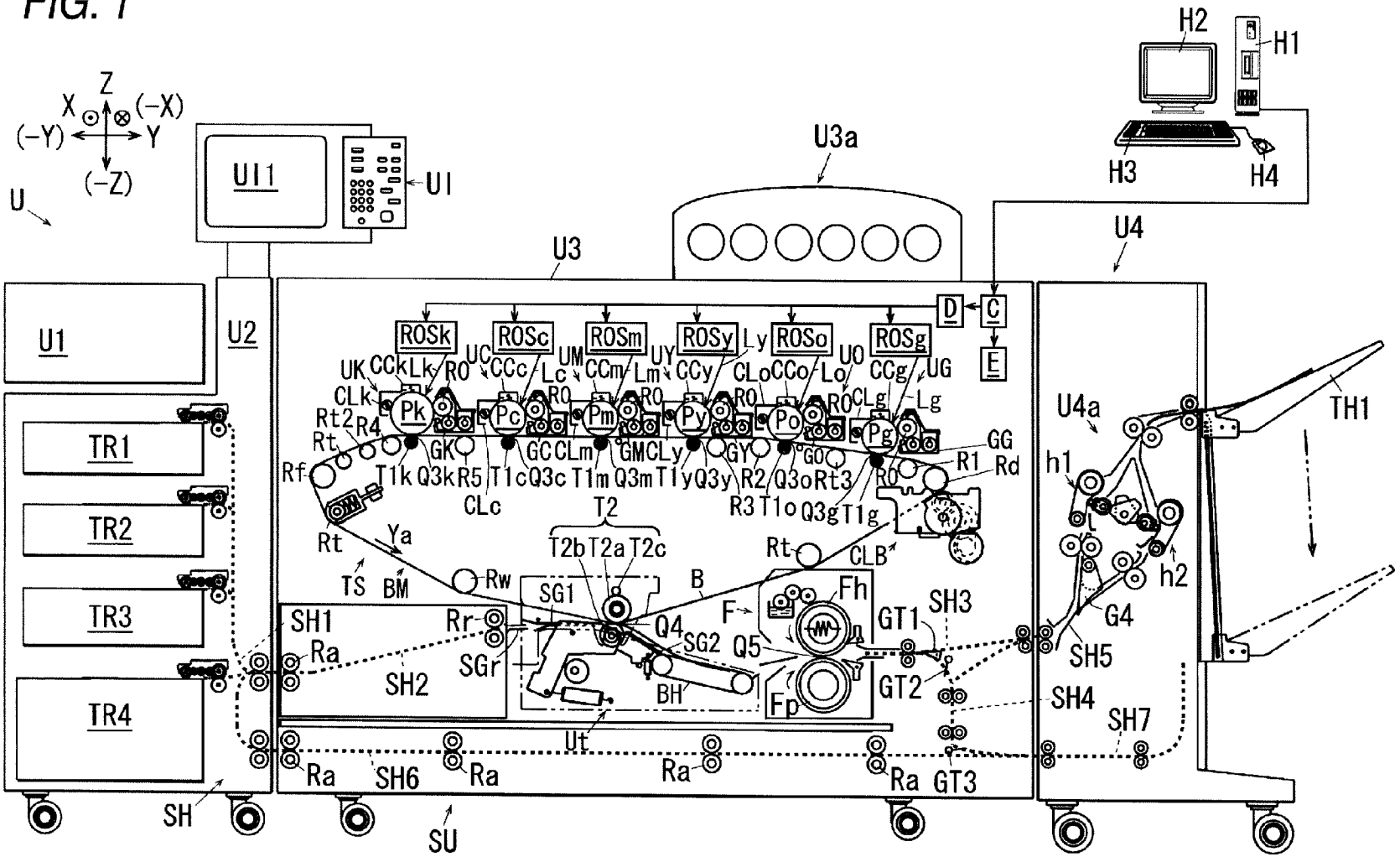
FIG. 1 is a general explanatory view of an image forming apparatus of a first example of the present invention.

Referring to the drawings, concrete examples of an exemplary embodiment of the present invention (hereinafter, referred to as examples) will be described; however, the present invention is not limited to the following examples:

For ease of understanding of the description that follows, in the drawings, the direction perpendicular to the plane of the figure will be referred to as X-axis direction; the right-to-left direction, as Y-axis direction; the top-to-bottom direction, as Z-axis direction; and the directions or the sides represented by the arrows X, -X, Y, -Y, Z and -Z, as forward, rearward, rightward, leftward, upward and downward, or front side, rear side, right side, left side, upper side and lower side, respectively.

Moreover, in the figure, "○" with "■" inside indicates an arrow extending from the rear to the front of the plane of the figure, and "○" with "x" inside indicates an arrow extending from the front to the rear of the plane of the figure.

In the following description using the drawings, for ease of understanding, illustration of members other than the members necessary for the description are omitted as appropriate.

First Example

FIG. 1 is a general explanatory view of an image forming apparatus U according to a first example of the present invention.

In FIG. 1, the image forming apparatus U of the first example is provided with a user interface UI as an example of an operation unit, an image input device U1 as an example of an image information input device, a sheet feeding device U2, an image forming apparatus main unit U3, and a sheet processing device U4.

The user interface UI is provided with input buttons such as a copy start key as an example of an image formation start button, a copy count setting key as an example of an image formation count setting button and a numeric keypad as an example of number input buttons, and a display device UI1.

The image input device U1, which is an example of an automatic document feeding device, is constituted by an image scanner or the like as an example of an image reading device. In FIG. 1, in the image input device U1, a non-illustrated document is read, converted into image information, and inputted to the image forming apparatus main unit U3. To the image forming apparatus main unit U3 of the first example to which a client personal computer PC as an example of an image information transmitting apparatus is connected, image formation color setting information where the image formation colors used at the time of the image forming operation are set and image information color-separated according to the set image formation colors are inputted from the client personal computer PC.

The client personal computer PC of the first example is constituted by a so-called calculating apparatus, a so-called computer apparatus, and includes a computer main unit H1 as an example of the image information transmitting apparatus main unit, a display H2 as an example of a display member, a keyboard H3 and a mouse H4 as examples of input members, and a non-illustrated hard disk drive as an example of an information storing member.

The following are provided: sheet feeding trays TR1 to TR4 as an example of a plurality of sheet feeding members; and a sheet feeding path SH1 for taking out a recording sheet as an example of the final transfer material or a medium accommodated in the sheet feeding trays TR1 to TR4 and conveying it to the image forming apparatus main unit U3.

In FIG. 1, the image forming apparatus main unit U3 is provided with: an image recorder that performs image recording on the recording sheet conveyed from the sheet feeding device U2; a toner dispenser device U3*a* as an example of a developer supplying device; a sheet conveying path SH2; a sheet ejecting path SH3; a sheet reversing path SH4; and a sheet circulating path SH6. The image recorder will be described later.

The image forming apparatus main unit U3 is also provided with: a controller C; a laser driving circuit D as an example of a latent image writing device driving circuit controlled by the controller C; and a power supply circuit E controlled by the controller C. The laser driving circuit D outputs laser driving signals corresponding to image information of green (G), orange (O), yellow (Y), magenta (M), cyan (C) and black (BK) inputted from the image input device U1, to latent image forming devices ROSg, ROSo, ROSy, ROSm, ROSc and ROSk for the colors G to K at a preset time, so-called timing.

Under the latent image forming devices ROSg to ROSk for the colors, image holding member units UG, UO, UY, UM, UC and UK for the colors G to K and developing units GG, GO, GY, GM, GC and GK for the colors G to K as an example of developing devices are arranged so as to be detachably attachable.

The black image holding member unit UK is an example of a sixth image holding member, and is provided with a photoreceptor drum Pk for black as an example of an image holding member for black, a charging unit CCk and a cleaner CLk as an example of a cleaning device for the image holding member. On the right side of the photoreceptor drum Pk, a developing roll R0 as an example of a developing member of the black developing unit GK is disposed so as to adjoin it.

The image holding member units UG to UC for the other colors G to C are also provided with a photoreceptor drum Pg for green as an example of a first image holding member and an example of a first spot color image holding member, a photoreceptor drum Po for orange as an example of a second image holding member and an example of a second spot color image holding member, a photoreceptor drum Py for yellow as an example of a third image holding member, a photoreceptor drum Pm for magenta as an example of a fourth image holding member, and a photoreceptor drum Pc for cyan as an example of a fifth image holding member, respectively. For the photoreceptor drums Pg to Pc, corresponding charging units CCg, CCo, CCy, CCm and CCc and cleaners CLg, CLo, CLy, CLm and CLc for the colors are arranged so as to adjoin them, respectively. On the right sides of the photoreceptor drums Pg to Pc, the developing rolls R0 as an example of the developing members of the developing units GG to GC for the colors are also arranged so as to adjoin them.

In the first example, the photoreceptor drum Pk for black which is highly frequently used and whose surface is largely worn has a large diameter compared with the photoreceptor drums Pg to Pc for the other colors so that it is capable of high-speed rotation and lasts long.

The photoreceptor drum Pg for green and the photoreceptor drum Po for orange constitute two photoreceptor drums Pg and Po for the spot colors as an example of the spot color image holding members. The photoreceptor drum Py for yellow, the photoreceptor drum Pm for magenta and the photoreceptor drum Pc for cyan constitute three photoreceptor drums Py, Pm and Pc for the three colors as an example of the image holding members for the three colors.

The image holding member units UG to UK and the developing units GG to GK constitute visible image forming members (UG+GG), (UO+GO), (UY+GY), (UM+GM), (UC+GC) and (UK+GK), respectively.

In FIG. 1, the photoreceptor drums Pg to Pk are uniformly charged by the charging units CCg to CCk, respectively, and then, electrostatic latent images are formed on the surfaces thereof by laser beams Lg, Lo, Ly, Lm, Lc and Lk as an example of latent image writing light outputted by the latent image forming devices ROSg to ROSk. The electrostatic latent images on the surfaces of the photoreceptor drums Pg to Pk are developed into images of green (G), orange (O), yellow (Y), magenta (M), cyan (C) and black (K), toner images as an example of the visible images by the developing units GG to GK.

The toner images on the surfaces of the photoreceptor drums Pg to Pk are transferred onto an intermediate transfer belt B as an example of the intermediate transfer material so as to be placed one on another by primary transfer rolls T1*g*, T1*o*, T1*y*, T1*m*, T1*c* and T1*k* as an example of intermediate transfer members in primary transfer regions Q3*g*, Q3*o*, Q3*y*, Q3*m*, Q3*c* and Q3*k* as an example of intermediate transfer regions set below, so that a multi-color image, a so-called color image is formed on the intermediate transfer belt B. The color image formed on the intermediate transfer belt B is conveyed to a secondary transfer region Q4.

When only black image data is present, only the photoreceptor drum Pk and the developing unit GK for black are used, and only a black toner image is formed.

In the first example, setting is preliminarily made so that the line segment connecting the primary transfer regions Q3*y*, Q3*m* and Q3*c* of the photoreceptor drums Py to Pc for the three colors and the primary transfer region Q3*k* of the photoreceptor drum Pk for black extends linearly.

After the primary transfer, the residual toner on the surfaces of the photoreceptor drums Pg to Pk is cleaned by the cleaners CLg to CLk for the photoreceptor drums, respectively.

Figure 2:
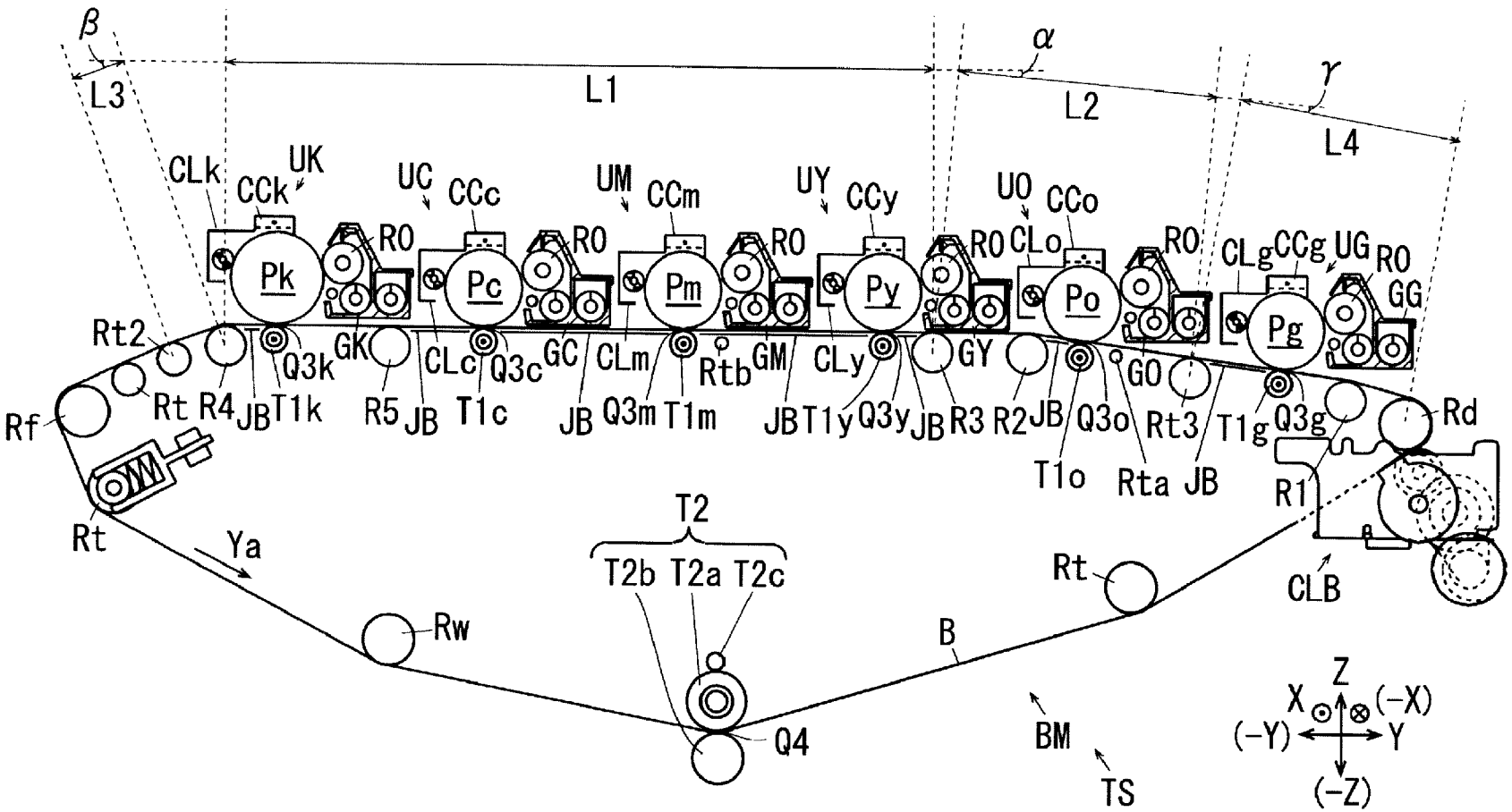
FIG. 2 is a general explanatory view of a belt module of the first example of the present invention.

FIG. 2 is a general explanatory view of a belt module BM of the first example of the present invention.

The belt module BM has the intermediate transfer belt B. At the right end on the rear side of the intermediate transfer belt B, a belt driving roll Rd as an example of a first tension applying member and an example of an intermediate transfer material driving member is disposed. The belt driving roll Rd rotates the intermediate transfer belt B in the direction of the arrow Ya as the rotation direction. On the rear side of the intermediate transfer belt B, a second intermediate transfer material supporting member Rt2 as an example of a second tension applying member is disposed on the left side of the photoreceptor drum Pk for black, and a third intermediate transfer material supporting member Rt3 as an example of a fourth tension applying member is disposed between the photoreceptor drums Pg and Po for green and orange. Moreover, on the rear side of the intermediate transfer belt B, a plurality of tension rolls Rt as an example of tension applying members that apply tension to the intermediate transfer belt B are disposed. Further, on the rear side of the intermediate transfer belt B, a walking roll Rw as an example of a meandering preventing member that prevents the intermediate transfer belt B from meandering, a plurality of idler rolls Rf as an example of driven members, and a backup roll T2*a* as an example of a secondary transfer opposing member are disposed.

Thus, in the belt module BM of the first example, the intermediate transfer belt B is stretched by the rolls Rd, Rt2, Rt3, Rt, Rw, Rf, T2*a* and the like.

Moreover, in the first example, on the upstream side in the direction of the arrow Ya of the primary transfer roll T1*g* for green, a first retracting roll R1 as an example of a first moving member supported so as to be movable in a contact and separation direction which is vertical to the direction of the arrow Ya is disposed. The first retracting roll R1 of the first example is supported so as to be movable between a first contact position to bring the intermediate transfer belt B in contact with the photoreceptor drum Pg for green and a first separation position to separate the intermediate transfer belt B therefrom. That is, the first retracting roll R1 is supported so as to be movable between the first contact position as an example of the first position to apply tension to the intermediate transfer belt B and the first separation position as an example of a second position farther from the intermediate transfer belt B than the first contact position.

Between the primary transfer rolls T1*o* and T1*y* for orange and yellow, a second retracting roll R2 as an example of a second moving member structured similarly to the first retracting roll R1 and a third retracting roll R3 as an example of the third moving member are arranged in a line. The second retracting roll R2 of the first example is supported so as to be movable between a second contact position to bring the intermediate transfer belt B in contact with the photoreceptor drum Po for orange and a second separation position to separate the intermediate transfer belt B therefrom. That is, the second retracting roll R2 is supported so as to be movable between the second contact position as an example of the first position to apply tension to the intermediate transfer belt B and the second separation position as an example of the second position farther from the intermediate transfer belt B than the second contact position. Moreover, the third retracting roll R3 of the first example is supported so as to be movable between a third contact position to bring the intermediate transfer belt B simultaneously in contact with the photoreceptor drums Py to Pc for the three colors and a third separation position to separate the intermediate transfer belt B simultaneously therefrom. That is, the third retracting roll R3 is supported so as to be movable between the third contact position as an example of the first position to apply tension to the intermediate transfer belt B and the third separation position as an example of the second position farther from the intermediate transfer belt B than the third contact position.

On the downstream side in the direction of the arrow Ya of the primary transfer roll T1*k* for black, a fourth retracting roll R4 as an example of a fourth moving member structured similarly to the retracting rolls R1 to R3 is disposed. The fourth retracting roll R4 of the first example is supported so as to be movable between a fourth contact position to bring the intermediate transfer belt B in contact with the photoreceptor drum Pk for black and a fourth separation position to separate the intermediate transfer belt B therefrom. That is, the fourth retracting roll R4 is supported so as to be movable between the fourth contact position as an example of the first position to apply tension to the intermediate transfer belt B and the fourth separation position as an example of the second position farther from the intermediate transfer belt B than the fourth contact position.

Further, between the primary transfer rolls T1*c* and T1*k* for cyan and black, a fifth retracting roll R5 as an example of a fifth moving member structured similarly to the retracting rolls R1 to R4 is disposed. The fifth retracting roll R5 of the first example is supported so as to be movable between a fifth contact position to bring either the photoreceptor drums Py to Pc for the three colors or the photoreceptor drum Pk for black, or both of them in contact with the intermediate transfer belt B and a fifth separation position to separate the photoreceptor drums Py to Pk for yellow, magenta, cyan and black from the intermediate transfer belt B. That is, the fifth retracting roll R5 is supported so as to be movable between the fifth contact position as an example of the first position to apply tension to the intermediate transfer belt B and the fifth separation position as an example of the second position farther from the intermediate transfer belt B than the fifth contact position.

In the first example, as shown in FIG. 2, setting is preliminarily made so that a first line segment L1 along the outer surface of the intermediate transfer belt B from the third retracting roll R3 in the third contact position to the fourth retracting roll R4 in the fourth contact position is linear. Moreover, setting is preliminarily made so that a second line segment L2 along the outer surface of the intermediate transfer belt B from the fixedly supported third intermediate transfer material supporting member Rt3 to the third retracting roll R3 in the third contact position is linear. Moreover, setting is preliminarily made so that a third line segment L3 along the outer surface of the intermediate transfer belt B from the fourth retracting roll R4 in the fourth contact position to the fixedly supported second intermediate transfer material supporting member Rt2 is linear. Moreover, the intermediate transfer belt B is preliminarily set so that a fourth line segment L4 along the outer surface of the intermediate transfer belt B from the fixedly supported belt driving roll Rd to the third intermediate transfer material supporting member Rt3 is linear.

In the first example, the second line segment L2 is inclined downward at a first angle $\alpha$ with respect to the first line segment L1. The third line segment L3 is inclined downward by a second angle $\beta$ with respect to the first line segment L1. The fourth line segment L4 is inclined downward at a third angle $\gamma$ with respect to the second line segment L2.

Thus, in the first example, the posture of the intermediate transfer belt B is preliminarily set so that the line segments L2, L3 and L4 extend so as to incline downward which is the rear side of the intermediate transfer belt B, at the angles $\alpha$, $\beta$ and $(\alpha+\beta)$ with respect to the line segment L1.

Between the third intermediate transfer material supporting member Rt3 and the second retracting roll R2, a first separation-time stretching roll Rta as an example of the third tension applying member is disposed. The first separation-time stretching roll Rta of the first example is preliminarily disposed in a first separation-time contact position where it is separated from the intermediate transfer belt B when the second retracting roll R2 is moved to the second contact position and it supports the intermediate transfer belt B from the rear side when the second retracting roll R2 is moved to the second separation position.

Between the third retracting roll R3 and the fifth retracting roll R5, a second separation-time stretching roll Rtb as an example of another (i.e., a second) third tension applying member is disposed. The second separation-time stretching roll Rtb of the first example is preliminarily disposed in a second separation-time contact position where it is separated from the intermediate transfer belt B when the retracting rolls R3 and R5 are moved to the contact positions and it supports the intermediate transfer belt B from the rear side when the third retracting roll R3 is moved to the third separation position or when the fifth retracting roll R5 is moved to the fifth separation position.

On the downstream side in the direction of the arrow Ya of the primary transfer rolls T1*g* to T1*k* for green to black, a plate-form charge removing sheet metal JB as an example of a charge removing member that removes the charge on the rear surface of the intermediate transfer belt B is disposed. The charge removing sheet metal JB of the first example is disposed out of contact with the intermediate transfer belt B, and can be disposed, for example, in a position 2 mm away from the rear surface of the intermediate transfer belt B.

The rolls Rd, Rt, Rw, Rf, T2*a* and R1 to R5 constitute belt supporting rolls Rd, Rt, Rw, Rf, T2*a* and R1 to R5 as an example of the intermediate transfer material supporting member that rotatably supports the intermediate transfer belt B from the rear side.

The intermediate transfer belt B, the belt supporting rolls Rd, Rt, Rt2, Rt3, Rta, Rtb, Rw, Rf, T2*a* and R1 to R5, the primary transfer rolls T1*g* to T1*k*, the charge removing sheet metal JB and the like constitute the belt module BM of the first example.

Under the backup roll T2*a*, a secondary transfer unit Ut is disposed. A secondary transfer roll T2*b* as an example of a secondary transfer member of the secondary transfer unit Ut is disposed with the intermediate transfer belt B in between so that it can separate from and come into contact with the backup roll T2*a*, and the secondary transfer region Q4 is formed by the region where the secondary transfer roll T2*b* is pressed against the intermediate transfer belt B. A contact roll T2*c* as an example of a voltage applying contact member abuts on the backup roll T2*a*, and the rolls T2*a* to T2*c* constitute a secondary transferrer T2 as an example of a final transfer member.

To the contact roll T2*c*, a secondary transfer voltage of the same polarity as the charging polarity of the toner is applied at preset timing by a power supply circuit controlled by the controller C.

Under the belt module BM, the sheet conveying path SH2 is disposed. The recording sheet fed from the sheet feeding path SH1 of the sheet feeding device U2 is conveyed to the sheet conveying path SH2 by a conveying roll Ra as an example of a medium conveying member, and is conveyed to the secondary transfer region Q4 by way of a medium guiding member SGr and a pre-transfer medium guiding member SG1 by a REGE roll Rr as an example of a sheet feed time adjusting member in synchronism with the conveyance of the toner image to the secondary transfer region Q4.

The medium guiding member SGr together with the REGE roll Rr is fixedly supported by the image forming apparatus main unit U3.

The toner image on the intermediate transfer belt B is transferred onto the recording sheet by the secondary transferrer T2 when passing through the secondary transfer region Q4. In the case of a full-color image, the toner images primarily transferred onto the surface of the intermediate transfer belt B so as to be placed one on another are secondarily transferred onto the recording sheet collectively.

The intermediate transfer belt B after the secondary transfer is cleaned by a belt cleaner CLB as an example of an intermediate transfer material cleaning unit. The secondary transfer roll T2*b* and the belt cleaner CLB are supported so that it can be separated from and come into contact with the intermediate transfer belt B.

The belt module BM, the secondary transferrer T2, the belt cleaner CLB and the like constitute a transfer device TS that transfers the images on the surfaces of the photoreceptor drums Py to Po onto the recording sheet.

The recording sheet having the toner image secondarily transferred thereonto is conveyed to a fixing device F by way of a post-transfer medium guiding member SG2 and a sheet conveying belt BH as an example of a pre-fixing medium conveying member. The fixing device F is provided with a heating roll Fh as an example of a heat fixing member and a pressurizing roll Fp as an example of a pressurization fixing member, and a fixing region Q5 is formed by the region where the heating roll Fh and the pressurizing roll Fp are pressed against each other.

The toner image on the recording sheet is fixed by heating by the fixing device F when passing through the fixing region Q5. On the downstream side of the fixing device F, a conveying path switching member GT1 is provided. The conveying path switching member GT1 selectively switches the recording sheet conveyed along the sheet conveying path SH2 and having undergone heat fixing in the fixing region Q5, to either the sheet ejecting path SH3 or the sheet reversing path SH4 of the sheet processing device U4. The recording sheet conveyed to the sheet ejecting path SH3 is conveyed to a sheet conveying path SH5 of the sheet processing device U4.

In the middle of the sheet conveying path SH5, a curl correcting device U4*a* is disposed, and on the sheet conveying path SH5, a switching gate G4 as an example of a conveying path switching member is disposed. The switching gate G4 conveys the recording sheet conveyed from the sheet conveying path SH3 of the image forming apparatus main unit U3, toward either a first curl correcting member h1 or a second curl correcting member h2 according to the direction of curve, so-called curl. The recording sheet conveyed to the first curl correcting member h1 or the second curl correcting member h2 has its curl corrected as it passes. The recording sheet having its curl corrected is ejected from an ejecting roll as an example of an ejecting member onto an output tray TH1 as an example of an output portion of the sheet processing device U4 in a condition where its image fixed surface faces upward, a so-called face-up condition.

The recording sheet conveyed toward the sheet reversing path SH4 of the image forming apparatus main unit U3 by the conveying path switching member GT1 passes while pushing away a conveyance direction restricting member made of an elastic thin-film member, a so-called mylar gate GT2, and is conveyed to the sheet reversing path SH4 of the image forming apparatus main unit U3.

To the downstream side end of the sheet reversing path SH4 of the image forming apparatus main unit U3, the sheet circulating path SH6 and a sheet reversing path SH7 are connected, and at the part of the connection, a mylar gate GT3 is disposed. The recording sheet conveyed to the sheet conveying path SH4 through the switching gate GT1 passes through the mylar gate GT3 to be conveyed toward the sheet reversing path SH7 of the sheet processing device U4. In the case of duplex printing, the recording sheet conveyed along the sheet reversing path SH4 once passes through the mylar gate GT3 as it is to be conveyed to the sheet reversing path SH7, and then, is conveyed in the opposite direction, that is, switched back to have its conveyance direction restricted by the mylar gate GT3, so that the switched-back recording sheet is conveyed toward the sheet circulating path SH6. The recording sheet conveyed to the sheet circulating path SH6 passes through the sheet feeding path SH1 to be re-conveyed to the transfer region Q4.

On the other hand, when after the rear end of the recording sheet conveyed along the sheet reversing path SH4 passes through the mylar gate GT2, the recording sheet is switched back before the rear end thereof passes the mylar gate GT3, the conveyance direction of the recording sheet is restricted by the mylar gate GT2, and the recording sheet is conveyed to the sheet conveying path SH5 in a reversed condition. After having its curl corrected by the curl correcting device U4*a*, the reversed recording sheet can be ejected onto the sheet output tray TH1 of the sheet processing device U4 in a condition where the image fixed surface of the recording sheet faces downward, that is, a face-down condition.

The elements represented by the reference designations SH1 to SH7 constitute a sheet conveying path SH. The elements represented by the reference designations SH, Ra, Rr, Rh, SGr, SG1, SG2, BH and GT1 to GT3 constitute a medium conveying device SU.

(Description of Links Ln1 to Ln4)

Figure 3A:
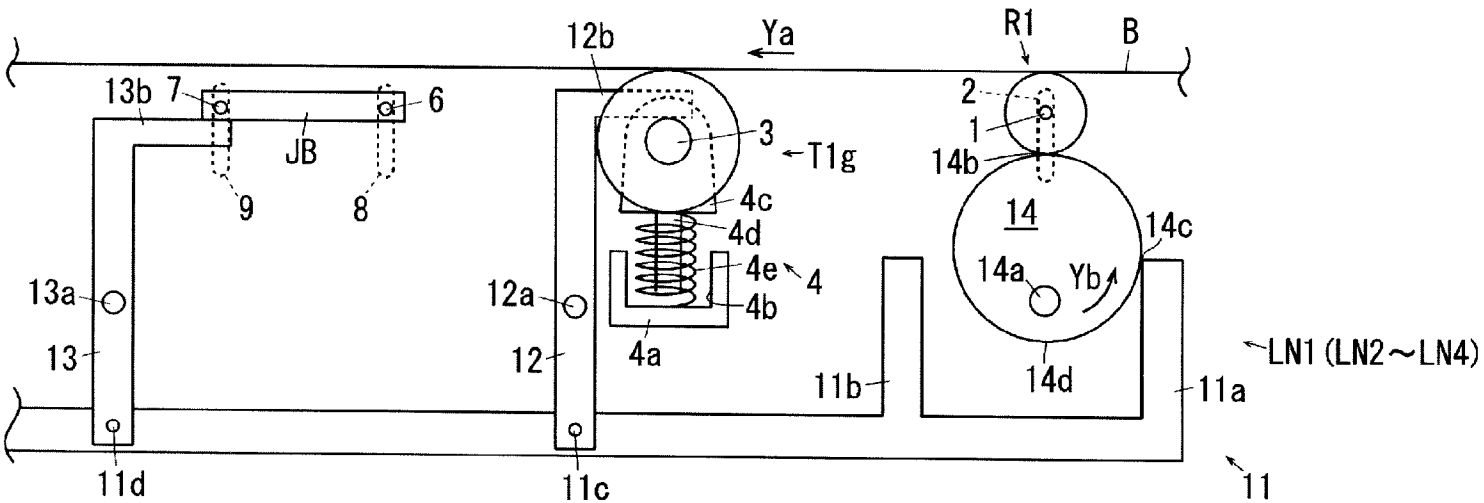
FIGS. 3A and 3B are relevant part enlarged explanatory views of a first link of the first example of the present invention, FIG. 3A being a condition explanatory view of the first link when a first retracting roll is moved to a contact position and FIG. 3B being a condition explanatory view of the first link when the first retracting roll is moved to a separation position.
Figure 3B:
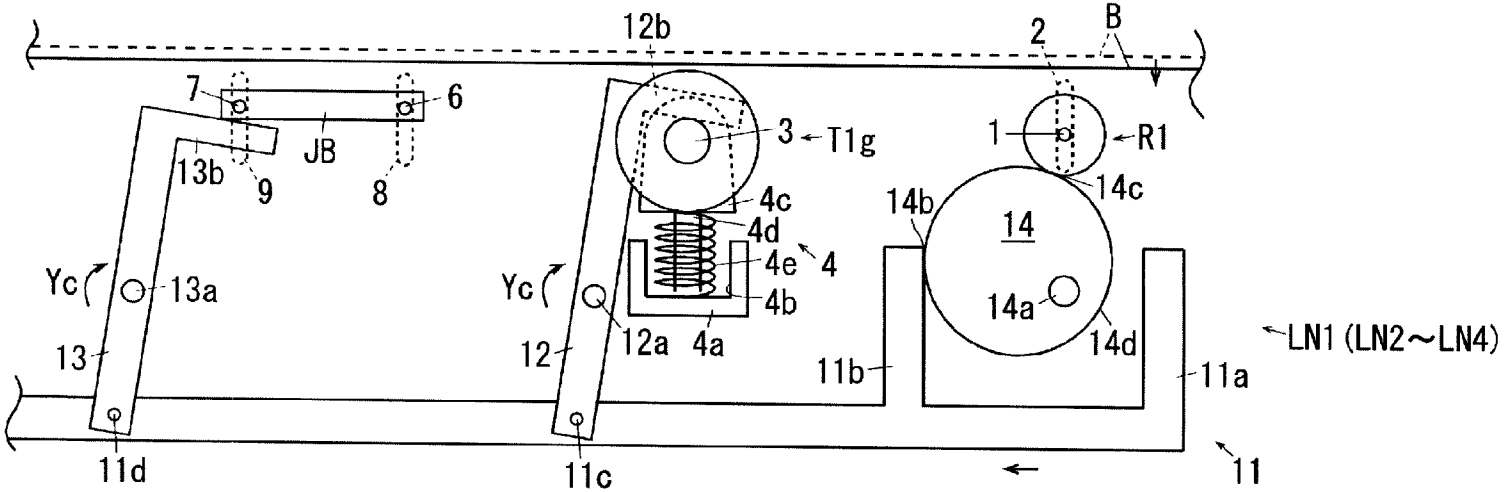

FIGS. 3A and 3B are relevant part enlarged explanatory views of a first link LN1 of the first example of the present invention. FIG. 3A is a condition explanatory view of the first link LN1 when the first retracting roll R1 is moved to the first contact position. FIG. 3B is a condition explanatory view of the first link LN1 when the first retracting roll R1 is moved to the separation position.

In FIGS. 3A and 3B, a rotation shaft 1 of the first retracting roll R1 of the first example is rotatably supported in a condition where it passes through first guide grooves 2 extending in the contact and separation direction and formed in non-illustrated frame members disposed at the front and rear ends of the belt module BM, respectively. That is, the first retracting roll R1 of the first example is supported so as to be movable in the contact and separation direction by the rotation shaft 1 being guided by the first guide grooves 2.

A rotation shaft 3 of the primary transfer roll T1*g* for green is supported by a pressing member 4 extending in the contact and separation direction and supported by the frame members of the belt module BM. The pressing member 4 of the first example has a pedestal portion 4*a* supported by the frame members. In the pedestal portion 4*a*, an elastic member accommodating space 4*b* extending in the contact and separation direction is formed. On the intermediate transfer belt B side of the pedestal portion 4*a*, a bearing portion 4*c* rotatably supporting the rotation shaft 3 is disposed, and on the lower surface of the bearing portion 4*c*, an elastic member passing through supporting portion 4*d* extending into the elastic member accommodating space 4*b* is formed. Between the pedestal portion 4*a* and the bearing portion 4*c*, a pressing spring 4*e* as an example of an elastic member is attached in a condition where it is accommodated in the elastic member accommodating space 4*b* of the pedestal portion 4*a* and the elastic member passing through supporting portion 4*d* of the bearing portion 4*c* passes therethrough. That is, the primary transfer roll T1*g* for green of the first example is supported so as to be movable in the contact and separation direction in a condition where it is pressed toward the intermediate transfer belt B by the pressing spring 4*e* capable of stretching and contracting along the elastic member accommodating space 4*b* and the elastic member passing through supporting member 4*d*.

At both ends in the direction of the arrow Ya of the charge removing sheet metal JB, protrusions 6 and 7 protruding outward from the front and rear ends of the charge removing sheet metal JB are formed, and the protrusions 6 and 7 are supported in a condition where they pass through a second guide groove 8 and a third guide groove 9 extending in the contact and separation direction and formed in the frame members of the belt module BM, respectively. That is, the charge removing sheet metal JB of the first example is supported so as to be movable in the contact and separation direction by the protrusions 6 and 7 being guided by the guide grooves 8 and 9.

Under the first retracting roll R1, the primary transfer roll T1*g* for green and the charge removing sheet metal JB, a link main unit 11 as an example of an interlocking member main unit movable in the direction of the arrow Ya is disposed so as to extend from the upstream side in the direction of the arrow Ya of the first retracting roll R1 to the downstream side in the direction of the arrow Ya of the charge removing sheet metal JB. At the upstream side end in the direction of the arrow Ya of the link main unit 11 of the first example, a first engagement-receiving portion 11*a* extending toward the intermediate transfer belt B is formed. On the link main unit 11, a second engagement-receiving portion 11*b* extending toward the intermediate transfer belt B is formed parallel to the first engagement-receiving portion 11*a* in a position corresponding to the downstream side in the direction of the arrow Ya of the first retracting roll R1 and the upstream side in the direction of the arrow Ya of the primary transfer roll T1*g* for green. Moreover, on the link main unit 11, a first coupling shaft 11*c* and a second coupling shaft 11*d* are formed in positions corresponding to the downstream side in the direction of the arrow Ya of the primary transfer roll T1*g* for green and the downstream side in the direction of the arrow Ya of the charge removing sheet metal JB, and a first interlocking arm 12 and a second interlocking arm 13 as examples of the first arm member and the second arm member extending toward the intermediate transfer belt B are rotatably supported by the coupling shafts 11*c* and 11*d*.

The central parts of the interlocking arms 12 and 13 of the first example are rotatably supported by a first rotation shaft 12*a* and a second rotation shaft 13*a* supported by the frame members of the belt module BM, respectively. At the upper end of the first interlocking arm 12, a first contact portion 12*b* is formed that extends toward the upstream side in the direction of the arrow Ya and is in contact with the rotation shaft 3 from above. At the lower end of the second interlocking arm 13, a second contact portion 13*b* is formed that extends toward the upstream side in the direction of the arrow Ya and is in contact with the charge removing sheet metal JB from below.

Between the engagement-receiving portions 11*a* and 11*b*, a decentering cam 14 as an example of a decentering rotating member is disposed. The decentering cam 14 of the first example is disk form in cross section, and the rotation center 14*a* of the decentering cam 14 is rotatably supported by the frame members of the belt module BM.

On the periphery of the decentering cam 14, the following are preset: a first end point 14*b* which is an end point farthest from the rotation center 14*a*; a second end point 14*c* which is an end point 90° away from the first end point 14*b* toward the upstream side in the direction of the arrow Yb which is an example of a decentering rotating member rotation direction; and a third end point 14*d* which is an end point 180° away from the first end point 14*b* toward the upstream side in the direction of the arrow Yb and closest to the rotation center 14*a*.

In the first example, setting is preliminarily made so that when the lower end of the first retracting roll R1 is supported in a condition where it is in contact with the first end point 14*b* of the decentering cam 14 as shown in FIG. 3A, the first retracting roll R1 is moved to the first contact position to bring the intermediate transfer belt B in contact with the photoreceptor drum Pg.

In this case, the lower end of the first retracting roll R1 is supported in a condition where the first engagement-receiving portion 11*a* of the link main unit 11 is engaged with the decentering cam 14 at the second end point 14*c* disposed at the upstream end in the direction of the arrow Ya of the decentering cam 14.

When the decentering cam 14 is rotated in the direction of the arrow Yb from the condition shown in FIG. 3A, the end point supporting the lower end of the first retracting roll R1 is moved, so that the first retracting roll R1 is brought into a condition where its lower end is supported in a condition where it is in contact with the neighborhood of the second end point 14*c* of the decentering cam 14 as shown in FIG. 3B. In this case, setting is preliminarily made so that the first retracting roll R1 is moved to the separation position to separate the intermediate transfer belt B from the photoreceptor drum Pg by tension or its own weight. At this time, the second engagement-receiving portion 11*b* of the link main unit 11 is pressed by the periphery of the decentering cam 14 to be moved toward the downstream side in the direction of the arrow Ya.

With the movement of the coupling shafts 11*c* and 11*d* toward the downstream side in the direction of the arrow Ya, the interlocking arms 12 and 13 rotate in the direction of the arrow Yc opposite to the direction of the arrow Yb with the rotation shafts 12*a* and 13*a* as the rotation center, respectively. Therefore, as shown in FIG. 3B, the contact portions 12*b* and 13*b* are rotated toward the link main unit 11. Consequently, the primary transfer roll T1*g* for green is pressed by the first contact portion 12*b* from above, so that it is moved toward the link main unit 11 against the pressing force of the pressing spring 4*e*. The charge removing sheet metal JB is also moved toward the link main unit 11 by its own weight from a condition where its lower surface is supported by the second contact portion 13*b* at the upper ends of the guide grooves 8 and 9.

Thus, the first retracting roll R1, the primary transfer roll T1*g* for green and the charge removing sheet metal JB move in a direction away from the photoreceptor drum Pg in synchronism with one another, so that the intermediate transfer belt B is separated from the photoreceptor drum Pg. In the first example, setting is also preliminarily made so that the first retracting roll R1, the primary transfer roll T1*g* for green and the charge removing sheet metal JB are separated from the intermediate transfer belt B.

When the decentering cam 14 is rotated in the direction of the arrow Yc from the condition shown in FIG. 3B, that is, when it is rotated in the opposite direction, the end point supporting the lower end of the first retracting roll R1 is moved, so that the first retracting roll R1 is returned to a condition where its lower end is supported in a condition where it is in contact with the neighborhood of the first end point 14*b* of the decentering cam 14 as shown in FIG. 3A. In this case, the first retracting roll R1 is returned to the first contact position and comes into contact with the intermediate transfer belt B to lift it. At this time, with the rotation of the decentering cam 14, the first engagement-receiving portion 11*a* of the link main unit 11 is pressed by the periphery of the decentering cam 14 to be moved toward the upstream side in the direction of the arrow Ya.

With the movement of the coupling shafts 11*c* and 11*d* toward the upstream side in the direction of the arrow Ya, the interlocking arms 12 and 13 rotate in the direction of the arrow Yb opposite to the direction of the arrow Yc with the rotation shafts 12*a* and 13*a* as the rotation center, respectively. Therefore, as shown in FIG. 3A, the contact portions 12*b* and 13*b* are rotated toward the intermediate transfer belt B. Consequently, the primary transfer roll T1*g* for green is released from the pressing by the first contact portion 12*b*, so that it is moved toward the intermediate transfer belt B by the pressing force of the pressing spring 4*e* and pushes the intermediate transfer belt B against the photoreceptor drum Pg. Moreover, the charge removing sheet metal JB has its lower surface lifted by the second contact portion 13*b*.

The link main unit 11, the interlocking arms 12 and 13, the decentering cam 14 and the like constitute a first link LN1 as an example of an interlocking member that synchronizes the movement of the intermediate transfer belt B responsive to the movement of the first retracting roll R1 between the first contact position and the first separation position, and the movement of the primary transfer roll T1*g* for green and the charge removing sheet metal JB.

In the first link LN1 of the first example, setting is preliminarily made so that the movement amount of the intermediate transfer belt B by the first retracting roll R1, the primary transfer roll T1*g* for green and the like and the movement amount of the charge removing sheet metal JB are the same.

Between the second retracting roll R2, and the primary transfer roll T1*o* for orange disposed on the upstream side in the direction of the arrow Ya of the second retracting roll R2 and the charge removing sheet metal JB, a second link LN2 as an example of the interlocking member structured similarly to the first link LN1 is disposed. Moreover, between the third retracting roll R3, and the primary transfer rolls T1*y* to T1*c* for yellow, magenta and cyan disposed on the downstream side in the direction of the arrow Ya of the third retracting roll R3 and the charge removing sheet metal JB, a third link LN3 as an example of the interlocking member structured similarly to the links LN1 and LN2 is disposed.

Further, between the fourth retracting roll R4, and the primary transfer roll T1*k* for black disposed on the upstream side in the direction of the arrow Ya of the fourth retracting roll R4 and the charge removing sheet metal JB, a fourth link LN4 as an example of the interlocking member structured similarly to the links LN1 to LN3 is disposed.

Since the first link LN1 and the other links LN2 to LN4 have a similar structure, detailed descriptions of the links LN2 to LN4 is omitted.

(Description of Controller C of First Example)

FIG. 4 is a block diagram of the functions that the controller C of the image forming apparatus U of the first example of the present invention is provided with.

In FIG. 4, the controller C and a controller of a computer main unit H1 of the client personal computer PC include: an input and output (I/O) interface as an example of an input and output signal adjusting portion that performs signal reception and output from and to the outside, the adjustment of the levels of the input and output signals, and the like; a read only memory (ROM) storing programs, data and the like for executing necessary processings; a random access memory (RAM) for temporarily storing necessary data; a central processing unit (CPU) that performs processings corresponding to the programs stored in the ROM; and a computer as an example of the calculating apparatus having a clock generator and the like, and by executing the programs stored in the ROM, various functions can be implemented.

(Description of Controller of Computer Main Unit H1 of Client Personal Computer PC)

The hard disk drive of the client personal computer PC stores basic software that controls the basic operation of the client personal computer PC, a so-called operating system OS, an image formation information transmitting program AP1 as an application program, and other non-illustrated pieces of software.

(Image Formation Information Transmitting Program AP1)

FIG. 5 is an explanatory view of an image formation color setting image of the first example of the present invention.

The controller of the client personal computer PC has the following function implementing units:

C101: Image Formation Color Setting Unit

As shown in FIG. 5, the image formation color setting unit C101 has an image formation color setting image displaying unit C101*a* that displays, on a display H2, the image formation color setting image 101 for the user to set the image formation colors used at the time of the image forming operation, so-called at the time of job execution, and sets the image formation colors.

In FIG. 5, on the image formation color setting image 101 of the first example, the following fourteen patterns are displayed: a case where all of the six colors "GOYMCK" are used; cases where five colors "GYMCK" and "OYMCK" are used, respectively; cases where four colors "YMCK", "GYMC" and "OYMC" are used, respectively; a case where three colors "YMC" are used; cases where two colors "GO", "GK" and "OK" are used, respectively; cases where one color "G", "O" and "K" is used, respectively; and a case where "none" of the colors, that is, not a color is used. The case where not a color is used is, for example, for the initialization setting of the intermediate transfer belt B for reducing the degradation of the motion quality (MQ), so-called speed non-uniformity based on a change of the conveyance resistances of the rolls Rd, Rt, Rt2, Rt3, Rta, Rtb, Rw, Rf, T2*a*, R1 to R5, T1*g* to T1*k* and T2*a* stretching the intermediate transfer belt B, the cleaning operation and the like.

The image formation color setting image 101 also has fourteen check boxes 101*a* as an example of image formation color selecting buttons corresponding to the fourteen patterns. Thus, in the image formation color setting image 101 of the first example, the user can select only one of the fourteen patterns of image formation colors with the check box 101*a*.

C102: Image Formation Color Setting Information Storing Unit

The image formation color setting information storing unit C102 stores, as the image formation color setting information, the image formation colors set by the image formation color setting unit C101. The image formation color setting information storing unit C102 of the first example stores, as the image formation color setting information, any of "GOYMCK", "GYMCK", "OYMCK", "YMCK", "GYMC", "OYMC", "YMC", "GO", "GK", "OK", "G", "O", "K" and "none" selected with the check box 101*a* of the image formation color setting image 101.

C103: Image Information Color Separating Unit

The image information color separating unit C103 color-separates the image information on which the job is to be executed, based on the image formation color setting information stored in the image formation color setting information storing unit C102. When green (G) and orange (O) which are spot colors are included in the image formation setting information, the image information color separating unit C103 of the first example color-separates the image information so that the amounts of use of the toners of the other colors Y, M, C and K are minimized.

C104: Image Formation Information Transmitting Unit

The image formation information transmitting unit C104 transmits, to the image forming apparatus U, image formation information including the image formation color setting information stored in the image formation color setting information storing unit C102 and the image information color-separated by the image information color separating unit C103.

(Signal Output Elements Connected to Controller C)

To the controller C, output signals of the following signal output elements UI and the like are inputted:

UI: User Interface

The user interface UI detects the inputs to the copy start key, the copy count setting key, the numeric keypad, the display device UI1 and the like, and inputs the detection signals to the controller C.

(Control-Receiving Elements Connected to Controller C)

The controller C outputs the control signals of the following control-receiving elements D1 and E:

D1: Main Motor Driving Circuit

The main motor driving circuit D1 as an example of a main driving source driving circuit drives a main motor M1 as an example of a main driving source to thereby rotate the photoreceptor drums Pg to Pk, the developing rolls R0 of the developing units GG to GK, the heating roll Fh of the fixing device F, the conveying roll Ra, the belt driving roll Rd of the belt module BM and the like through a gear as an example of the driving force transmitting member.

E: Power Supply Circuit

The power supply circuit E has a development power supply circuit E1, a charging power supply circuit E2, a transfer roll power supply circuit E3, and a heating roll power supply circuit E4.

E1: Development Power Supply Circuit

The development power supply circuit E1 applies a development voltage to the developing rolls R0 of the developing units GG to GK.

E2: Charging Power Supply Circuit

The charging power supply circuit E2 applies a charging voltage to the charging units CCg to CCk.

E3: Transfer Roll Power Supply Circuit

The transfer roll power supply circuit E3 applies transfer voltages to the primary transfer rolls T1*g* to T1*k* and the contact roll T2*c* of the secondary transferrer T2.

E4: Heating Roll Power Supply Circuit

The heating roll power supply circuit E4 applies power for heating to a heater as an example of a heating member of the heating roll Fh of the fixing device F.

(Functions of Controller C)

The controller C has the following function implementing units by programs for controlling the operations of the control-receiving elements D1 and E according to the output signals of the signal output elements UI:

C1: Job Controlling Unit

The job controlling unit C1 as an example of the image forming operation controlling unit controls the operations of the latent image forming devices ROSg to ROSk, the visible image forming members (UG+GG) to (UK+GK), the transfer device TS, the fixing unit F, the medium conveying device SU and the like in response to the input of the copy start key, thereby executing a job as an example of the image forming operation.

C2: Main Motor Driving Controlling Unit

The main motor driving controlling unit C2 as an example of the main driving source driving controlling unit controls the rotation of the main motor M1 through the main motor driving circuit D1, thereby controlling the rotations of the photoreceptor drums Pg to Pk, the developing rolls R0 of the developing units GG to GK, the heating roll Fh of the fixing device F, the conveying roll Ra, the belt driving roll Rd and the like.

C3: Power Supply Circuit Controlling Unit

The power supply circuit controlling unit C3 controls the actuation of the power supply circuit E to thereby control the supply of voltages and current to the developing rolls R0, the charging units CCg to CCk, the transfer rolls T1*g* to T1*k* and T2*c*, the heater of the heating roll Fh of the fixing device F and the like.

C4: Intermediate Transfer Belt Posture Controlling Unit

The intermediate transfer belt posture controlling unit C4 as an example of a contact and separation controlling unit and an example of an intermediate transfer member posture controlling unit is provided with: an image formation information receiving unit C4A that receives the image formation information transmitted by the image formation information receiving unit C104; a posture setting table storing unit C4B; a posture selecting unit C4C; a spot color side contact and separation controlling unit C4D; a three color side contact and separation controlling unit C4E; a black side contact and separation controlling unit C4F; and a fifth contact and separation controlling unit C4G, and controls the posture of the intermediate transfer belt B at the time of job execution.

FIG. 6 is an explanatory view of a posture setting table of the first example of the present invention.

C4B: Posture Setting Table Storing Unit

The posture setting table storing unit C4B as an example of a posture setting information storing unit stores, as shown in FIG. 6, the posture setting table TB as an example of the posture setting information for setting the posture of the intermediate transfer belt B corresponding to the image formation color setting information.

In FIG. 6, the posture setting table TB of the first example prestores first posture setting information to move all the retracting rolls R1 to R5 to the respective contact positions in response to the case where the image formation color setting information is "GOYMCK". Moreover, the posture setting table TB prestores second posture setting information to move the retracting rolls R1 and R3 to R5 to the respective contact positions and move the second retracting roll R2 to the second separation position in response to the case where the image formation color setting information is "GYMCK". Moreover, the posture setting table TB prestores third posture setting information to move the retracting rolls R2 to R5 to the respective contact positions and move the first retracting roll R1 to the first separation position in response to the case where the image formation color setting information is "OYMCK".

Moreover, the posture setting table TB prestores fourth posture setting information to move the retracting rolls R3 to R5 to the respective contact positions and move the retracting rolls R1 and R2 to the respective separation positions in response to the case where the image formation color setting information is "YMCK". Moreover, the posture setting table TB prestores fifth posture setting information to move the retracting rolls R1, R3 and R4 to the respective contact positions and move the retracting rolls R2 and R5 to the respective separation positions in response to the case where the image formation color setting information is "GYMC". Moreover, the posture setting table TB prestores sixth posture setting information to move the retracting rolls R2 to R4 to the respective contact positions and move the retracting rolls R1 and R5 to the respective separation positions in response to the case where the image formation color setting information is "OYMC". Moreover, the posture setting table TB prestores seventh posture setting information to move the retracting rolls R3 and R4 to the respective contact positions and move the retracting rolls R1, R2 and R5 to the respective separation positions in response to the case where the image formation color setting information is "YMC".

Moreover, the posture setting table TB prestores eighth posture setting information to move the retracting rolls R1 and R2 to the respective contact positions and move the retracting rolls R3 to R5 to the respective separation positions in response to the case where the image formation color setting information is "GO".

Moreover, the posture setting table TB prestores ninth posture setting information to move the retracting rolls R1, R4 and R5 to the respective contact positions and move the retracting rolls R2 and R3 to the respective separation positions in response to the case where the image formation color setting information is "GK". Moreover, the posture setting table TB prestores tenth posture setting information to move the retracting rolls R2, R4 and R5 to the respective contact positions and move the retracting rolls R1 and R3 to the respective separation positions in response to the case where the image formation color setting information is "OK".

Moreover, the posture setting table TB prestores eleventh posture setting information to move the first retracting roll R1 to the first contact position and move the retracting rolls R2 to R5 to the respective separation positions in response to the case where the image formation color setting information is "G". Moreover, the posture setting table TB prestores twelfth posture setting information to move the second retracting roll R2 to the second contact position and move the retracting rolls R1 and R3 to R5 to the respective separation positions in response to the case where the image formation color setting information is "0". Moreover, the posture setting table TB prestores thirteenth posture setting information to move the retracting rolls R4 and R5 to the respective contact positions and move the retracting rolls R1 to R3 to the respective separation positions in response to the case where the image formation color setting information is "K". Further, the posture setting table TB prestores fourteenth posture setting information to move all the retracting rolls R1 to R5 to the respective separation positions in response to the case where the image formation color setting information is "none".

Thus, the first posture setting information to the fourteenth posture setting information constitute the posture setting information of the first example.

C4C: Posture Selecting Unit

The posture selecting unit C4C selects the posture of the intermediate transfer belt B at the time of job execution based on the image formation color setting information included in the image formation information received by the image formation information receiving unit C4A and the posture setting table TB stored in the posture setting table storing unit C4B. The posture selecting unit C4C of the first example selects the posture of the intermediate transfer belt B at the time of job execution by selecting the posture setting information in the posture setting table TB corresponding to the image formation color setting information.

C4D: Spot Color Side Contact and Separation Controlling Unit

The spot color side contact and separation controlling unit C4D has a first spot color side contact and separation controlling unit C4D1 and a second spot color side contact and separation controlling unit C4D2, and controls the contact and separation between the photoreceptor drums Pg and Po for the spot colors G and O and the intermediate transfer belt B.

C4D1: First Spot Color Side Contact and Separation Controlling Unit

The first spot color side contact and separation controlling unit C4D1 moves the first retracting roll R1 to the first contact position when the photoreceptor drum Pg for green is used, and moves the first retracting roll R1 to the first separation position when the photoreceptor drum Pg for green is not used.

C4D2: Second Spot Color Side Contact and Separation Controlling Unit

The second spot color side contact and separation controlling unit C4D2 moves the second retracting roll R2 to the second contact position when the photoreceptor drum Po for orange is used, and moves the second retracting roll R2 to the second separation position when the photoreceptor drum Po for orange is not used.

C4E: Three Color Side Contact and Separation Controlling Unit

The three color side contact and separation controlling unit C4E moves the third retracting roll R3 to the third contact position when the photoreceptor drums Py to Pc for Y, M and C are used, and moves the third retracting roll R3 to the third separation position when the photoreceptor drums Py to Pc are not used.

C4F: Black Side Contact and Separation Controlling Unit

The black side contact and separation controlling unit C4F moves the fourth retracting roll R4 to the fourth contact position when the photoreceptor drum Pk for black is used, and moves the fourth retracting roll R4 to the fourth separation position when the photoreceptor drum Pk for black is not used.

C4G: Fifth Contact and Separation Controlling Unit

The fifth contact and separation controlling unit C4G moves the fifth retracting roll R5 to the fifth contact position when the photoreceptor drums Py to Pc for Y, M and C or the photoreceptor drum Pk for black is used, and moves the fifth retracting roll R5 to the fifth separation position when the photoreceptor drums Py to Pc or the photoreceptor drum Pk for black is not used.

Thus, the intermediate transfer belt posture controlling unit C4 of the first example controls the posture of the intermediate transfer belt B at the time of job execution by moving the retracting rolls R1 to R5 between the respective contact positions and the respective separation positions according to the posture setting information selected by the posture selecting unit C4C.

With respect to the flow of the processing by the image forming apparatus U of the first example of the present invention, illustration and detailed description with reference to a flowchart are omitted since it is performed only to move the retracting rolls R1 to R5 between the respective contact positions and the respective separation positions according to the posture setting information in the posture setting table TB corresponding to the image formation color setting information when the image formation information transmitted from the image formation information transmitting program AP1 of the client personal computer PC is received.

Working of the First Example

In the image forming apparatus U of the first example of the present invention having the above-described structure, when an image forming operation, a so-called job is executed, electrostatic latent images on the surfaces of the photoreceptor drums Pg to Pk are developed by the toners of the colors supplied to the developing rolls R0 of the developing units GG to GK. The toner images on the surfaces of the photoreceptor drums Pg to Pk are successively primarily transferred onto the intermediate transfer belt B so as to be placed one on another by the primary transfer rolls T1*g* to T1*k* in the primary transfer regions Q3*g* to Q3*k*, thereby forming a color image. Then, the color image formed on the intermediate transfer belt B is conveyed to the secondary transfer region Q4 to be secondarily transferred onto the recording sheet by the secondary transferrer T2. In the belt module BM of the first example, the plate-form charge removing sheet metal JB as an example of the charge removing member is disposed in a non-contact manner on the downstream side in the direction of the arrow Ya of the primary transfer rolls T1*g* to T1*k*, and the charge on the intermediate transfer belt B is removed. Consequently, it is reduced that the toner image on the intermediate transfer belt B is scrambled or scattered by being locally charged by the discharge of the primary transfer rolls T1*g* to T1*k*.

Moreover, in the image forming apparatus U of the first example, when the image formation information transmitted from the client personal computer PC is received, the condition of the tension application to the intermediate transfer belt B is changed to thereby change the posture of the intermediate transfer belt B. In the specification of the present application, the "change of the condition of the tension application" refers to a change of the positions of the belt supporting rolls Rd, Rt, Rt2, Rt3, Rta, Rtb, Rw, Rf, T2*a*, R1 to R5 and T1*g* to T1*k* applying tension to the intermediate transfer belt B or a change of the magnitude of the applied tension. Therefore, it includes a case where the retracting rolls R1 to R5 are moved from the respective contact positions to the respective separation positions and apply no tension and a case where the applied tension is low.

Specifically, as shown in FIGS. 5 and 6, the posture setting information in the posture setting table TB corresponding to the image formation color setting information included in the received image formation information is selected and the retracting rolls R1 to R5 are moved between the respective contact positions and the respective separation positions according to the selected posture setting information, thereby changing the posture of the intermediate transfer belt B.

For example, when the image formation color setting information is "GOYMCK", the first posture setting information in the posture setting table TB is selected, and as shown in FIG. 2, all the retracting rolls R1 to R5 are moved to the respective contact positions.

Figure 7:
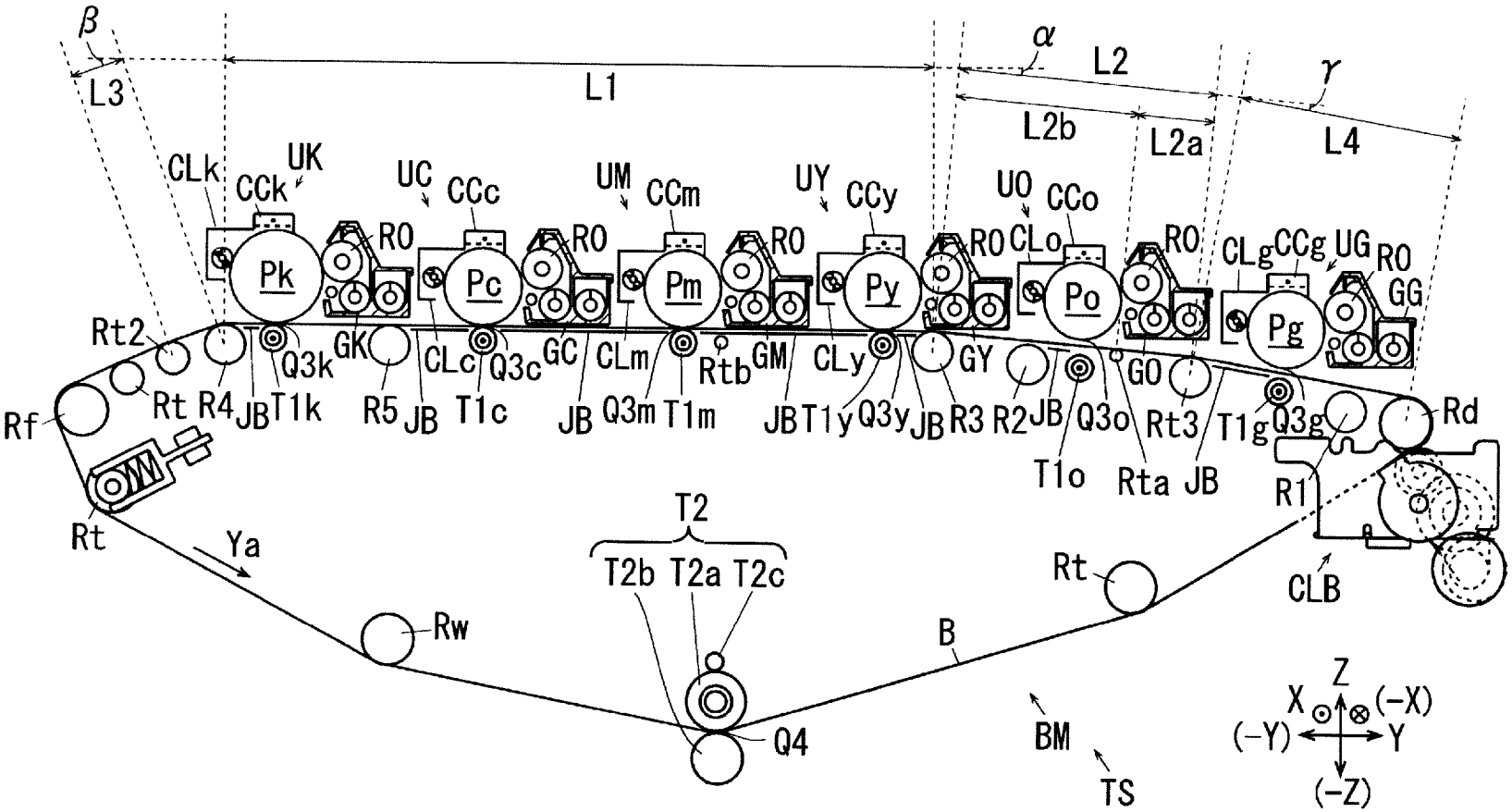
FIG. 7, which is a working explanatory view of the first example of the present invention, is an enlarged explanatory view of an example of the posture change of an intermediate transfer belt of the first example, and is an explanatory view of a condition where photoreceptor drums for green and orange are separated from the intermediate transfer belt from the condition of FIG. 2.

FIG. 7, which is a working explanatory view of the first example of the present invention, is an enlarged explanatory view of an example of the posture change of the intermediate transfer belt B of the first example, and is an explanatory view of a condition where the photoreceptor drums Pg and Po for green and orange are separated from the intermediate transfer belt B from the condition of FIG. 2.

Figure 8:
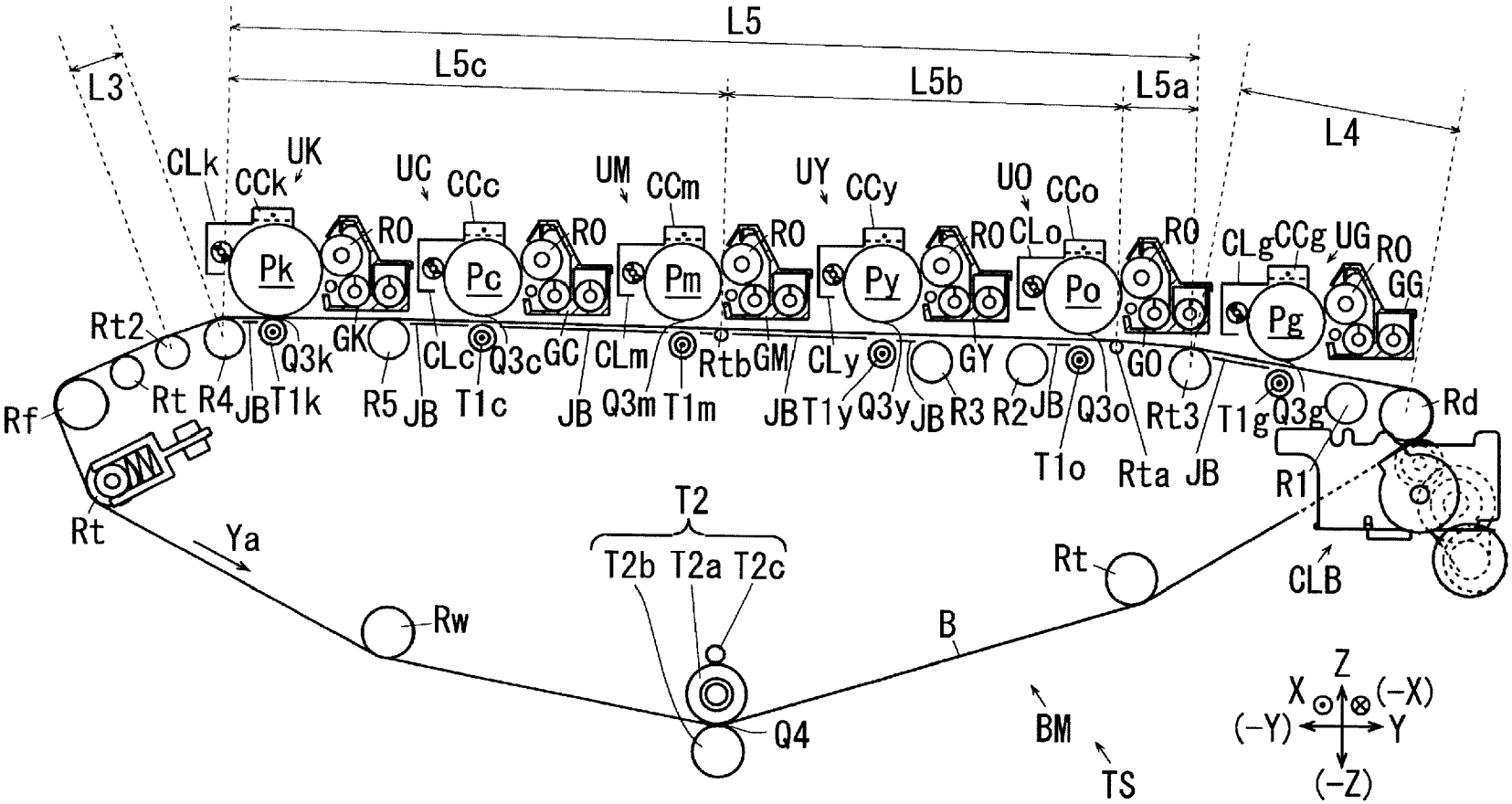
FIG. 8, which is a working explanatory view of the first example of the present invention, is an enlarged explanatory view of an example of the posture change of the intermediate transfer belt of the first example, and is an explanatory view of a condition where photoreceptor drums for yellow, magenta and cyan are separated from the intermediate transfer belt from the condition of FIG. 7.

FIG. 8, which is a working explanatory view of the first example of the present invention, is an enlarged explanatory view of an example of the posture change of the intermediate transfer belt B of the first example, and is an explanatory view of a condition where the photoreceptor drums Py, Pm and Pc for yellow, magenta and cyan are separated from the intermediate transfer belt B from the condition of FIG. 7.

Figure 9:
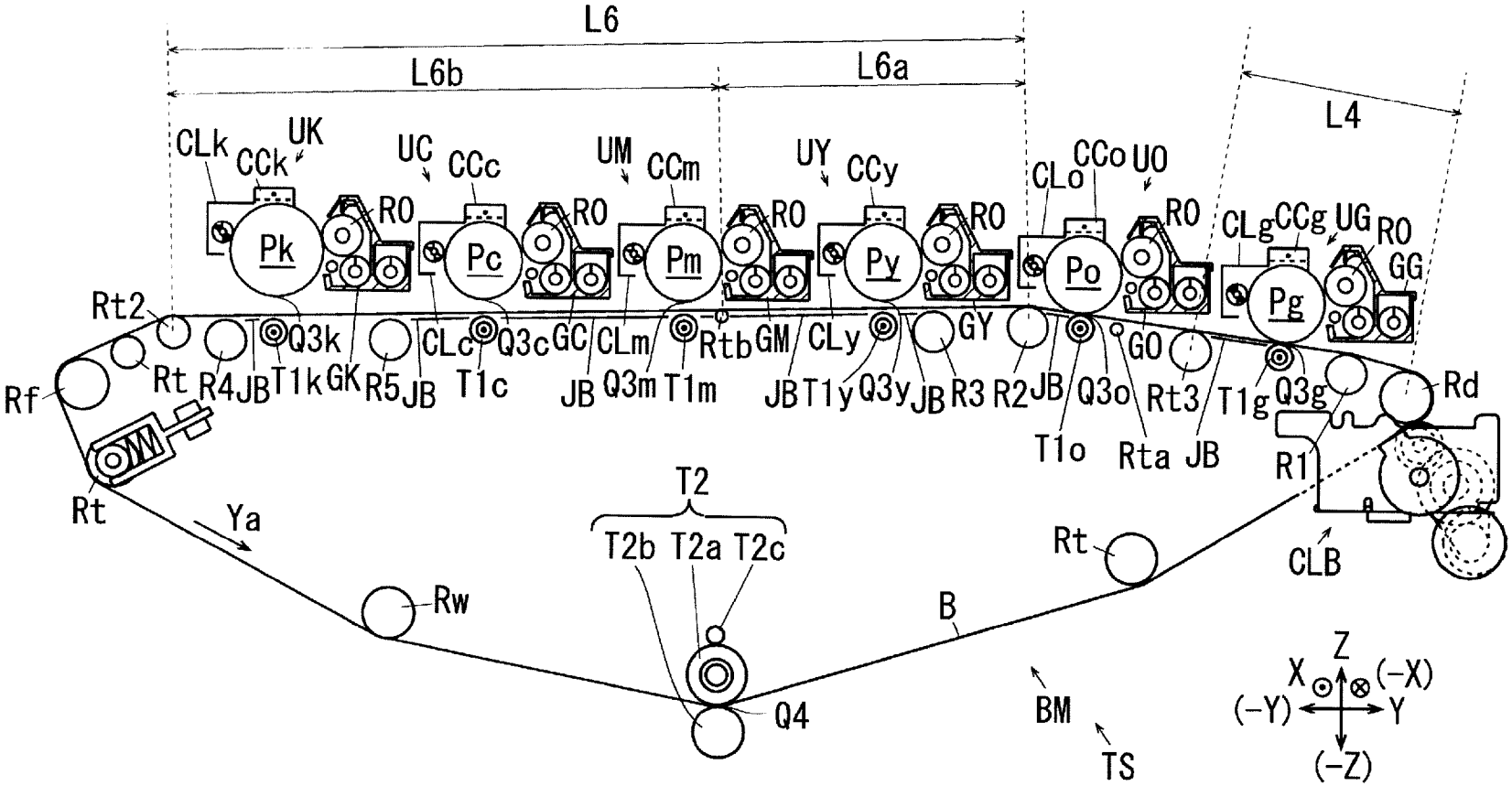
FIG. 9, which is a working explanatory view of the first example of the present invention, is an enlarged explanatory view of an example of the posture change of the intermediate transfer belt of the first example, and is an explanatory view of a condition where photoreceptor drums for yellow, magenta, cyan and black are separated from the intermediate transfer belt from the condition of FIG. 2.

FIG. 9, which is a working explanatory view of the first example of the present invention, is an enlarged explanatory view of an example of the posture change of the intermediate transfer belt B of the first example, and is an explanatory view of a condition where the photoreceptor drums Py, Pm, Pc and Pk for yellow, magenta, cyan and black are separated from the intermediate transfer belt B from the condition of FIG. 2.

When the image formation color setting information included in the received image formation information is "YMCK", the fourth posture setting information in the posture setting table TB is selected, and as shown in FIG. 7, the retracting rolls R1 and R2 are moved to the respective separation positions. When the image formation color setting information is "K", the thirteenth posture setting information in the posture setting table TB is selected, and as shown in FIG. 8, the retracting rolls R1 to R3 are moved to the respective separation positions. When the image formation color setting information included in the received image formation information is "GO", the eighth posture setting information in the posture setting table TB is selected, and as shown in FIG. 9, the retracting rolls R3 to R5 are moved to the respective separation positions.

Therefore, in the first example, when a so-called six-color mode, four-color mode, monochrome mode and the like are executed, the photoreceptor drums Pg to Pk not being used are separated from the intermediate transfer belt B. Consequently, in the image forming apparatus U of the first example, the time degradation such as wear of the members Pg to Pk and B are reduced. In particular, in the first example, as shown in FIG. 5, a total of fourteen patterns, one kind of six-color mode, two kinds of five-color modes, three kinds of four-color modes, one kind of three-color mode, three kinds of two-color modes, three kinds of one-color mode and one kind of zero-color mode are executed. Consequently, in the image forming apparatus U of the first example, the intermediate transfer belt B is changed to fourteen kinds of postures according to the fourteen kinds of patterns, and the time degradation such as wear of the members Pg to Pk and B is efficiently reduced.

In the first example, when the retracting rolls R1 to R5 are moved to the respective separation positions, the retracting rolls R1 to R5 are separated from the intermediate transfer belt B, and the corresponding primary transfer rolls T1*g* to T1*k* and charge removing sheet metals JB are simultaneously separated by the link LN1 to LN4 shown in FIG. 4. Consequently, in the image forming apparatus U of the first example, the time degradation such as wear of the intermediate transfer belt B is further reduced.

As shown in FIGS. 7 to 9, when the three photoreceptor drums Py, Pm and Pc for the three colors Y, M and C are not used, the third retracting roll R3 is moved to the third separation position to thereby simultaneously separate the photoreceptor drums Py to Pc for the three colors. Consequently, in the image forming apparatus U of the first example, the mechanism for causing the photoreceptor drums Py to Pc for Y, M and C to come into contact and separate is made common, so that reduction in the number of parts and the like are possible.

Moreover, in the first example, as shown in FIG. 2, setting is preliminarily made so that the first line segment L1 along the outer surface of the intermediate transfer belt B from the third retracting roll R3 to the fourth retracting roll R4 is linear. That is, in the first example, the primary transfer regions Q3*g* to Q3*k* for Y, M, C and K are linear that particularly require the accuracy of the transfer position, the transfer time and the like of the primary transfer, that is, the accuracy of the color registration at the intermediate transfer belt B.

Consequently, in the image forming apparatus U of the first example, the accuracy of the color registration can be improved compared with when the first line segment L1 is not linear, so that high-quality color images are easily formed.

Moreover, in the first example, since the visible image forming members (UY+GY) to (UK+GK) for the colors Y, M, C and K can be arranged in the horizontal direction, the visible image forming members (UY+GY) to (UK+GK) can all be arranged in the same configuration and in the same condition. Consequently, in the image forming apparatus U of the first example, the parts of the visible image forming members (UY+GY) to (UK+GK) can be made common, so that the overall manufacturing cost of the image forming apparatus U can be reduced.

With respect to the spot colors G and O not requiring a color registration accuracy as high as that required by Y, M, C and K, the parts of the visible image forming members (UG+GG) and (U0+GO) for G and O can also be made common by minimizing the first angle $\alpha$ shown in FIG. 2 between the first line segment and the second line segment L2 along the outer surface of the intermediate transfer belt B from the third intermediate transfer material supporting member Rt3 to the third retracting roll R3 to make the intermediate transfer belt B extend as horizontally as possible. For example, when the first angle $\alpha$ is not more than 1.6°, the visible image forming members (UG+GG) and (U0+GO) for G and O are also detachably attachable in the direction perpendicular to the plane of the figure without interfering with the intermediate transfer belt B even if they are all structured and arranged in the same configuration as the visible image forming members (UY+GY) to (UK+GK) for Y, M, C and K.

Moreover, by minimizing the angles α, β and (α+β) shown in FIG. 2, the height of the intermediate transfer belt B in the vertical direction can be reduced. In this case, the height in the vertical direction from the lower end of the belt module BM to the upper end of the visible image forming members (UG+GG) to (UK+GK) can also be reduced, so that the overall height of the image forming apparatus U can be reduced.

In this case, even if the lengths in the vertical direction between the contact positions and the separation positions of the retracting rolls R1 to R5 are made short, the posture of the intermediate transfer belt B can be changed in the fourteen patterns without the members R1 to R5, T1*g* to T1*k* and JB coming into contact with the intermediate transfer belt B, and the posture change itself is small.

Moreover, when the posture change itself is small, before and after the posture change, the change is small of the meandering amount of the intermediate transfer belt B that fluctuates with changes of the stretching rolls (RD, Rt, Rt2, Rt3, Rta, Rtb, Rw, Rf, T2*a*, R1 to R5, T1*g* to T1*k*, T2*a*) stretching the intermediate transfer belt B. Consequently, in the image forming apparatus U of the first example, the increase in meandering due to the posture change can be reduced.

In the image forming apparatus U of the first example of the present invention having the above-described structure, the photoreceptor drums Pg and Po for the spot colors are disposed on the upstream side in the Ya direction of the photoreceptor drums Py to Pk for Y, M, C and K. That is, in the upstream side end part in the Ya direction, the photoreceptor drums Pg and Po for the spot colors are disposed, and in the downstream side end part in the Ya direction, the photoreceptor drum Pk for black is disposed. Moreover, the first example supports three kinds of one-color modes of "G", "O" and "K", that is, single color printing, so-called monochrome modes, and as the reference colors for single color printing, three colors of green (G), orange (O) and black (K) are set.

Thus, in the image forming apparatus U of the first example, the photoreceptor drums Pg, Po and Pk for the reference colors are disposed in two or more positions, and single color printing of each reference color can be set.

The developing units GG and GO of the visible image forming members (UG+GG) and (UO+GO) for the spot colors may be loaded with an arbitrary toner as well as green (G) toner and orange (O) toner; for example, they may be loaded with colorless clear toner. Moreover, they may be loaded with, for example, a color symbolizing an organization such as a company or a group as an example of the user, so-called corporate color. Consequently, when an image of a corporate color is formed, image degradation such as poor color tone or poor color development is reduced compared with when an image of the corporate color is formed with four colors Y, M, C and K.

Moreover, in the first example, in the client personal computer PC, when the image formation color setting information includes G and O, the image information is color-separated so that the amounts of use of the toners of the other colors Y, M, C and K are minimized. Consequently, for example, when G or O is the corporate color and a large number of corporate color images are formed, the amounts of use of Y, M, C and K toners are small compared with when printing is always performed with the four colors Y, M, C and K.

Moreover, in the first example, to change the posture of the intermediate transfer belt B so that the intermediate transfer belt B is separated from the photoreceptor drums Pg to Pk not being used, the three fixed rolls Rd, Rt2 and Rt3 and the five movable rolls R1 to R5 are preliminarily disposed in the respective positions shown in FIGS. 2 and 7 to 9. That is, in the first example, the rolls Rd, Rt2, Rt3 and R1 to R5 are preliminarily disposed so that they are arranged in the order of the line segment L4 (Rd, R1 and Rt3), the line segment L2 (Rt3, R2 and R3), the line segment L1 (R3, R5 and R4) and the line segment L3 (R4 and Rt2) in the Ya direction in a condition where the line segments L4, L2 and L3 are inclined downward at the angles (α+γ), α and β with respect to the first line segment L1, respectively. Consequently, for example, even when the posture setting information corresponding to "GYMCK", "GYMC", "GK" or "OK" is selected, that is, when the posture is changed to a condition where the photoreceptor drums Po and Py to Pc disposed in a central part in the Ya direction are not used, a so-called center dropout condition, the intermediate transfer belt B can be separated from the photoreceptor drums Po and Py to Pc only by moving the retracting rolls R1 to R5.

Thus, in the image forming apparatus U of the first example, the belt module BM is constituted by the minimum number of parts Rd, R1, Rt3, R2, R3, R5, R4 and Rt2 and the set values L1 to L4, α, β and γ by which a total of fourteen patterns of color settings shown in FIG. 5 can be realized based on the fourteen kinds of posture setting information shown in FIG. 6. Consequently, in the image forming apparatus U of the first example, compared with when the line segments L4, L2 and L3 are not inclined downward with respect to the line segment L1, the number of parts is reduced, and the overall manufacturing cost of the image forming apparatus U is reduced.

Moreover, in the first example, when the retracting roll R2 is moved to the second separation position as shown in FIG. 7, the members R2, T1*o* and JB are separated from the intermediate transfer belt B by the second link LN2, and the first separation-time stretching roll Rta disposed in the first separation-time contact position is in contact with the intermediate transfer belt B. Consequently, in the image forming apparatus U of the first example, the length of the part of the intermediate transfer belt B not supported by any stretching roll, the so-called free length is short compared with when the first separation-time stretching roll Rta is not disposed. That is, as shown in FIG. 7, while the free length when the first separation-time stretching roll Rta is absent is the length L2 between the stretching rolls Rt3 and R2, the free length when the first separation-time stretching roll Rta is present is shortened into a length L2*a* between the stretching rolls Rt3 and Rta and a length L2*b* between the stretching rolls Rta and R2.

Figure 10:
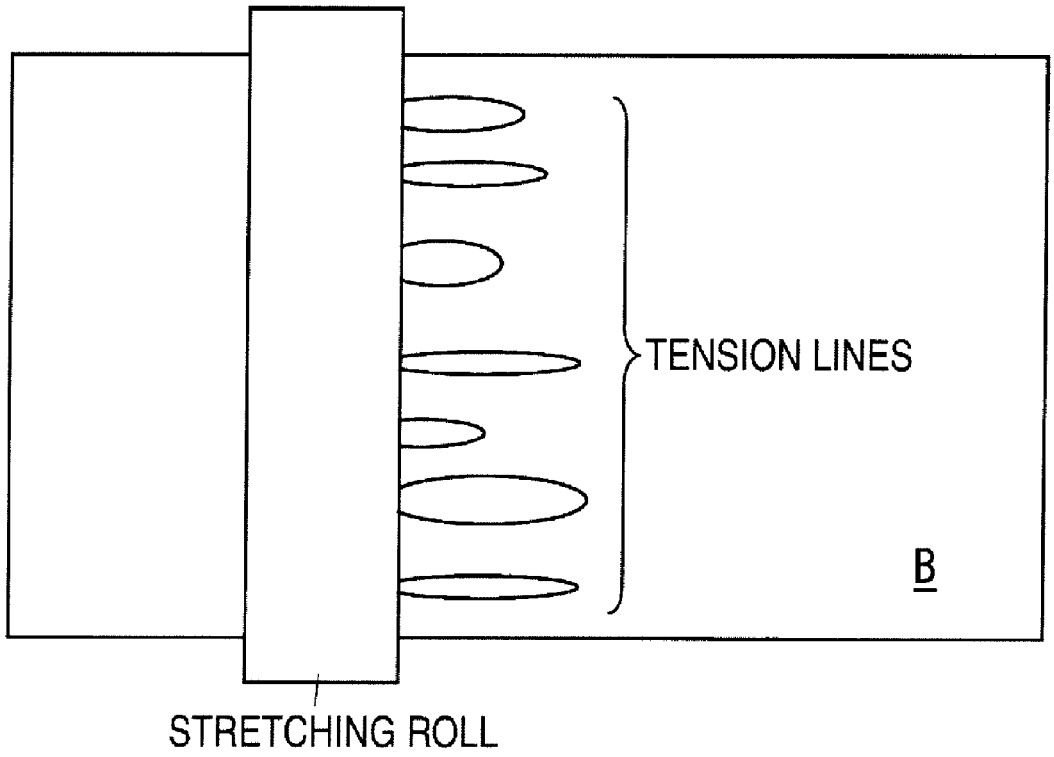
FIG. 10, which is a working explanatory view of the first example of the present invention, is an enlarged explanatory view of the tension lines caused on the intermediate transfer belt.

FIG. 10, which is a working explanatory view of the first example of the present invention, is an enlarged explanatory view of the tension lines caused on the intermediate transfer belt B.

As shown in FIG. 10, conventionally, if the free length is long, when the parallelism between the stretching rolls at the ends of the free length is low, that is, when the axial directions of the stretching rolls are not parallel to each other, the intermediate transfer belt B is readily waved along the direction of its width, and a phenomenon in which nonuniformity is caused in the gaps between the intermediate transfer belt B and the photoreceptor drums Pg to Pk, the so-called tension lines are readily caused on the upstream side of the parts where the stretching rolls are wound.

On the contrary, in the image forming apparatus U of the first example, compared with when the first separation-time stretching roll Rta is not disposed, the free lengths L2*a* and L2*b* at the second line segment L2 are short, so that the generation of the wrinkles in the Ya direction that can be caused because the distances between the stretching rolls are long, the so-called tension lines is reduced. Consequently, in the image forming apparatus U of the first example, compared with when the first separation-time stretching roll Rta is not disposed, the wrinkles caused on the intermediate transfer belt B due to the change in the condition of the tension application to the intermediate transfer belt B, that is, the tension lines are suppressed, so that image degradation such as poor transfer due to the generation of the tension lines is reduced.

Moreover, in the first example, as shown in FIG. 8, when the retracting rolls R2 and R3 are moved to the respective separation positions, the members R2, R3, T1*o* to T1*c* and JB are separated from the intermediate transfer belt B by the links LN2 and LN3, and the separation-time stretching rolls Rta and Rtb disposed in the respective separation-time contact positions are in contact with the intermediate transfer belt B. Consequently, as shown in FIG. 8, while the free length when the separation-time stretching rolls Rta and Rtb are absent is the length L5=L1+L2 between the stretching rolls R3 and R4, the free length when the separation-time stretching rolls Rta and Rtb are present is shortened into a length L5*a*=L2*a* between the stretching rolls Rt3 and Rta, a length L5*b* between the stretching rolls Rta and Rtb and a length L5*c* between the stretching rolls Rtb and R4. Consequently, in the image forming apparatus U of the first example, compared with when the separation-time stretching rolls Rta and Rtb are not disposed, the free length is divided to be shortened into the lengths L5*a* to L5*c*, so that the generation of the tension lines is reduced.

Moreover, in the first example, as shown in FIG. 9, when the second retracting roll R2 is moved to the second contact position and the retracting rolls R3 to R5 are moved to the respective separation positions, the members R3 to R5, T1*o* to T1*c* and JB are separated from the intermediate transfer belt B by the links LN3 and the LN4, and the second separation-time stretching roll Rtb disposed in the second separation-time contact position is in contact with the intermediate transfer belt B. Consequently, as shown in FIG. 9, while the free length when the second separation-time stretching roll Rtb is absent is the length L6 between the stretching rolls R2 and Rt2, the free length when the second separation-time stretching roll Rtb is present is shortened into a length L6*a* between the stretching rolls R2 and Rtb and a length L6*b* between the stretching rolls Rtb and Rt2. Consequently, in the image forming apparatus U of the first example, compared with when the second separation-time stretching roll Rtb is not disposed, the free length is divided to be shortened into the lengths L6*a* and L6*b*, so that the generation of the tension lines is reduced.

Consequently, in the image forming apparatus U of the first example, compared with when the separation-time stretching rolls Rta and Rtb are not disposed, the generation of the tension lines due to the change in the condition of the tension application to the intermediate transfer belt B is suppressed, so that image degradation such as poor transfer due to the generation of the tension lines is reduced. In particular, when the second separation-time stretching roll Rtb is present, it is reduced that the free lengths on the upstream side in the Ya direction and on the downstream side in the Ya direction of the second separation-time stretching roll Rtb are long, so that the image degradation due to the generation of the tension lines on the upstream side in the Ya direction and on the downstream side in the Ya direction is reduced.

Second Example

Next, a second example of the present invention will be described. In the description of the second example, the elements corresponding to the elements of the first example are denoted by the same reference designations, and detailed descriptions thereof are omitted.

Figure 11:
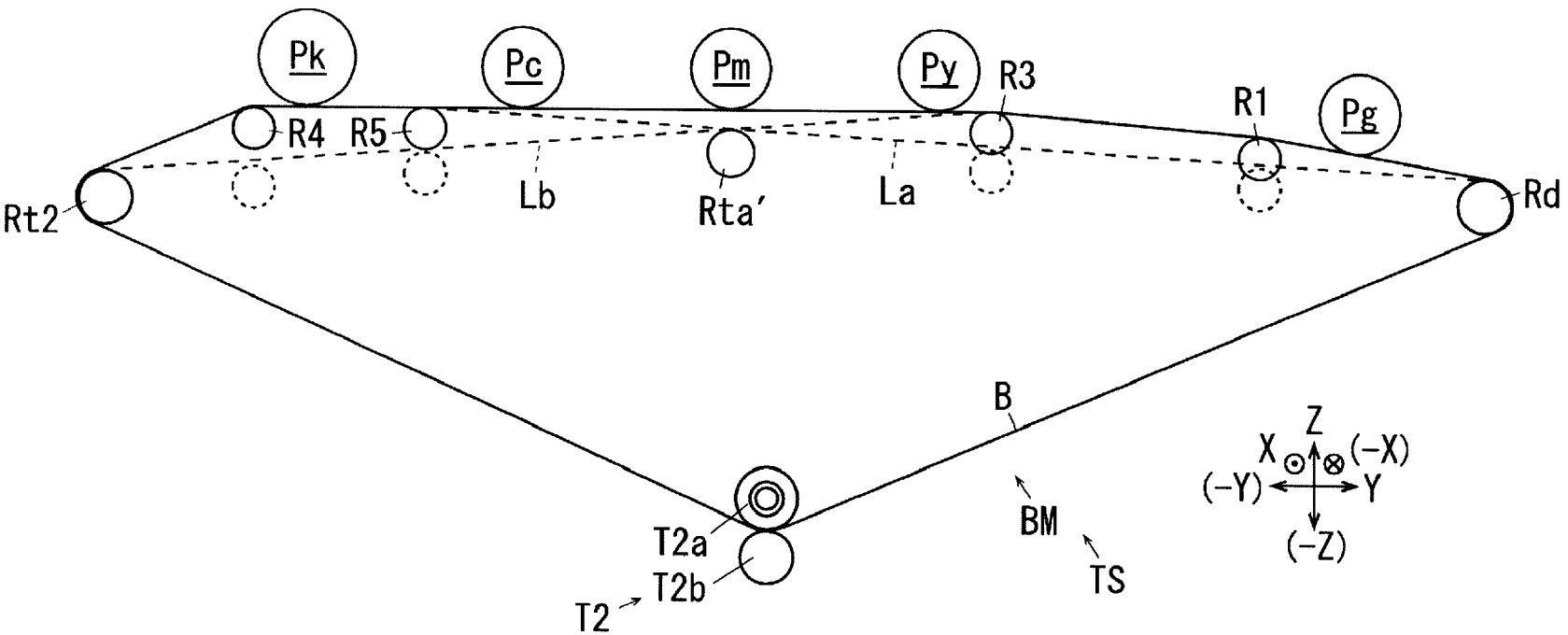
FIG. 11 is a relevant part enlarged explanatory view, corresponding to FIG. 2 of the first example, of a belt module of a second example of the present invention.

Although the second example is different from the above-described first example in the following points, it is structured similarly to the first example in the other points:

FIG. 11 is a relevant part enlarged explanatory view, corresponding to FIG. 2 of the first example, of a belt module BM of the second example of the present invention.

In FIG. 11, in the image forming apparatus U of the second example, compared with the structure of the first example, the latent image forming device ROSo, the visible image forming member (UO+GO), the primary transfer roll T1*o*, the primary transfer region Q3*o*, the charge removing sheet metal JB, the second retracting roll R2 and the second link LN2 for orange (O) are omitted. That is, while development of up to six colors is possible in the first example, development of up to five colors is possible in the second example.

Moreover, in the second example, the third intermediate transfer material supporting member Rt3 of the first example is omitted, and instead of the separation-time stretching rolls Rta and Rtb of the first example, a separation-time stretching roll Rta' as an example of the third tension applying member is disposed under the photoreceptor drum Pm for magenta. The separation-time stretching roll Rta' of the second example is preliminarily disposed, as shown by the broken lines in FIG. 11, in an intersection point position which is the point of intersection of a first line segment La connecting the fixedly supported driving roll Rd and the fifth retracting roll R5 in the fifth contact position and a second line segment Lb connecting the third retracting roll R3 in the third contact position and the fixedly supported second intermediate transfer material supporting member Rt2.

(Description of Controller C of Second Example)

FIG. 12 is a block diagram, corresponding to FIG. 4 of the first example, showing the functions that a controller C of the image forming apparatus U of the second example of the present invention is provided with.

FIG. 13 is an explanatory view, corresponding to FIG. 5 of the first example, of the image formation color setting image of the second example of the present invention.

In FIG. 12, the image formation information transmitting program AP1 of the client personal computer PC of the second example has an image formation color setting unit C101' instead of the image formation color setting unit C101.

C101': Image Formation Color Setting Unit

The image formation color setting unit C101' has an image formation color setting image displaying unit C101*a*' that displays the image formation color setting image 101' shown in FIG. 13 on the display H2, and sets the image formation colors.

In FIG. 13, in the image formation color setting image 101' of the second example, a total of eight patterns as follows is displayed: a case where all the five colors "GYMCK" are used; cases where four colors "GYMC" and "YMCK" are used, respectively; a case where three colors "YMC" are used; a case where two colors "GK" are used; cases where one color "G" and "K" is used, respectively; and a case where none of the colors, that is, not a color is used. Moreover, the image formation color setting image 101' has eight check boxes 101*a*' as an example of the image formation color selecting buttons corresponding to the total of eight patterns similarly to the check boxes 101*a* of the first example.

FIG. 14 is an explanatory view, corresponding to FIG. 6 of the first example, of a posture setting table of the second example of the present invention.

Moreover, in FIG. 12, the controller C of the second example has a posture setting table storing unit C4B' and a posture selecting unit C4C' instead of the posture setting table storing unit C4B and the posture selecting unit C4C. Moreover, in the controller C, the second spot color side contact and separation controlling unit C4D2 corresponding to the omitted second retracting roll R2 is omitted.

C4B': Posture Setting Table Storing Unit

The posture setting table storing unit C4B' as an example of the posture setting information storing unit stores a posture setting table TB' shown in FIG. 14.

In FIG. 14, the posture setting table TB' of the second example prestores first posture setting information to move all the retracting rolls R1 to R5 to the respective contact positions in response to the case where the image formation color setting information is "GYMCK". Moreover, the posture setting table TB' prestores second posture setting information to move the retracting rolls R3 and R4 to the respective contact positions and move the first retracting roll R1 to the first separation position in response to the case where the image formation color setting information is "YMCK". Moreover, the posture setting table TB' prestores third posture setting information to move the retracting rolls R1, R3 and R4 to the respective contact positions and move the fifth retracting roll R5 to the fifth separation position in response to the case where the image formation color setting information is "GYMC".

Moreover, the posture setting table TB' prestores fourth posture setting information to move the retracting rolls R3 and R4 to the respective contact positions and move the retracting rolls R1 and R5 to the respective separation positions in response to the case where the image formation color setting information is "YMC". Moreover, the posture setting table TB' prestores fifth posture setting information to move the retracting rolls R1, R4 and R5 to the respective contact positions and move the third retracting roll R3 to the third separation position in response to the case where the image formation color setting information is "GK".

Moreover, the posture setting table TB' prestores sixth posture setting information to move the retracting rolls R4 and R5 to the respective contact positions and move the retracting rolls R1 and R3 to the respective separation positions in response to the case where the image formation color setting information is "K". Moreover, the posture setting table TB' prestores seventh posture setting information to move the first retracting roll R1 to the first contact position and move the retracting rolls R3 to R5 to the respective separation positions in response to the case where the image formation color setting information is "G".

Further, the posture setting table TB' prestores eighth posture setting information to move all the retracting rolls R1 to R5 to the respective separation positions in response to the case where the image formation color setting information is "none".

Thus, the first posture setting information to the eighth posture setting information constitute the posture setting information of the second example.

C4C': Posture Selecting Unit

The posture selecting unit C4C' of the second example selects the posture of the intermediate transfer belt B at the time of job execution by selecting the posture setting information in the posture setting table TB' stored in the posture setting table storing unit C4B' corresponding to the image formation color setting information included in the image formation information received by the image formation information receiving unit C4A.

Working of Second Example

In the image forming apparatus U of the second example of the present invention having the above-described structure, as shown in FIG. 11, the separation-time stretching roll Rta' is disposed in the position of the point of intersection of the first separation line segment La between the members Rd and R5 and the second separation line segment Lb between the members R3 and Rt2. Consequently, the separation-time stretching roll Rta' of the second example can reliably stretch the intermediate transfer belt B when the third retracting roll R3 is moved to the third contact position and the retracting rolls R4 and R5 are moved to the respective separation positions and when the fifth retracting roll R5 is moved to the fifth contact position and the retracting rolls R1 and R3 are moved to the respective separation positions. That is, in the second example, the separation-time stretching roll Rta' in the intersection point position can be reliably in contact with the intermediate transfer belt B both when the posture of the intermediate transfer belt B is changed by a descent on the upstream side in the Ya direction and when the posture of the intermediate transfer belt B is changed by a descent on the downstream side in the Ya direction.

For example, when the separation-time stretching roll Rta' is disposed on the upstream side in the Ya direction of the intersection point position, the free length between the fixedly supported stretching rolls Rta' and Rt2 when the posture of the intermediate transfer belt B is changed by a descent on the downstream side in the Ya direction is longer than the free length between the fixedly supported stretching rolls Rd and Rta' when the posture of the intermediate transfer belt B is changed by a descent on the upstream side in the Ya direction. Conversely, for example, when the separation-time stretching roll Rta' is disposed on the downstream side in the Ya direction of the intersection point position, the free length between the stretching rolls Rd and Rta' when the posture of the intermediate transfer belt B is changed by a descent on the upstream side in the Ya direction is longer than the free length between the stretching rolls Rta' and Rt2 when the posture of the intermediate transfer belt B is changed by a descent on the downstream side in the Ya direction.

On the contrary, in the second example, since the separation-time stretching roll Rta' is disposed in the intersection point position, compared with when it is not disposed in the intersection point position, the free lengths between the fixedly supported stretching rolls Rd and Rta' and stretching rolls Rta' and Rt2 are never too long when the posture of the intermediate transfer belt B is changed by a descent on the upstream side in the Ya direction and when the posture of the intermediate transfer belt B is changed by a descent on the downstream side in the Ya direction.

Consequently, in the image forming apparatus U of the second example, only either when the posture of the intermediate transfer belt B is changed by a descent on the upstream side in the Ya direction or when the posture of the intermediate transfer belt B is changed by a descent on the downstream side in the Ya direction, it is reduced that the free length is long, and the generation of the tension lines shown in FIG. 10 is reduced.

Moreover, for example, when the separation-time stretching roll Rta' is disposed on the upstream side in the Ya direction of the intersection point position, the tension that the separation-time stretching roll Rta' applies to the intermediate transfer belt B is higher when the posture of the intermediate transfer belt B is changed by a descent on the upstream side in the Ya direction than when the posture of the intermediate transfer belt B is changed by a descent on the downstream side in the Ya direction. Conversely, for example, when the separation-time stretching roll Rta' is disposed on the downstream side in the Ya direction of the intersection point position, the tension that the separation-time stretching roll Rta' applies to the intermediate transfer belt B is higher when the posture of the intermediate transfer belt B is changed by a descent on the downstream side in the Ya direction than when the posture of the intermediate transfer belt B is changed by a descent on the upstream side in the Ya direction.

On the contrary, in the second example, since the separation-time stretching roll Rta' is disposed in the intersection point position, the tension that the separation-time stretching roll Rta' applies to the intermediate transfer belt B can be made the same between when the posture of the intermediate transfer belt B is changed by a descent on the upstream side in the Ya direction and when the posture of the intermediate transfer belt B is changed by a descent on the downstream side in the Ya direction.

Consequently, in the image forming apparatus U of the second example, only either when the posture of the intermediate transfer belt B is changed by a descent on the upstream side in the Ya direction or when the posture of the intermediate transfer belt B is changed by a descent on the downstream side in the Ya direction, the tension by the separation-time stretching roll Rta' is high, and it is reduced that the tension distribution of the entire intermediate transfer belt B is biased.

In addition, the image forming apparatus U of the second example capable of development of up to five colors produces similar effects to the image forming apparatus U of the first example capable of development of up to six colors.

(Modifications)

While the examples of the present invention have been described in detail, the present invention is not limited to the above-described examples but various modifications may be made within the scope of the gist of the present invention described in claims. Modifications (H01) to (H013) of the present invention will be shown below.

(H01) While the image forming apparatus U is a so-called multifunction apparatus in the above-described examples, the present invention is not limited thereto; the image forming apparatus U may be, for example, a printer or a fax.

(H02) In the above-described examples, the image forming apparatus U is not limited to one using toners of five colors or six colors but may be, for example, one using toners of not more than four colors or not less than seven colors.

(H03) While toners of six colors: green (G); orange (O); yellow (Y); magenta (M); cyan (C); and black (K) are used in the above-described examples, the present invention is not limited thereto; for example, toners of colors other than the above-mentioned six colors may be used instead of the toners of green (G) and orange (O). In addition, the following may be used: colorless toner for coating the image surface for waterproofing and protection; and magnetic toner for forming a magnetic wire of a preset configuration and arrangement, for example, linear, in the image on the printing sheet for theft prevention or the like. A theft preventing apparatus that detects a magnetic pulse generated from the magnetic wire is described, for example, in Japanese Unexamined Patent Application Publication No. 2006-256124, and is known.

(H04) While in the above-described examples, the primary transfer rolls T1*g* and T1*k* opposed to the photoreceptor drums Pg to Pk are disposed in the primary transfer regions Q3*g* to Q3*k*, the present invention is not limited thereto; for example, non-contact-type primary transfer corotrons may be disposed instead of the primary transfer rolls T1*g* to T1*k*. In this case, by preliminarily disposing the primary transfer corotrons so that even when the retracting rolls R1 to R5 are moved to the separation positions, the corresponding primary transfer corotrons not being used are out of contact, the effects of the present invention are produced without the primary transfer corotrons interlocking with the movements of the retracting rolls R1 to R5 and the charge removing sheet metals JB.

(H05) While in the above-described examples, the intermediate transfer belt B and the photoreceptor drums Pg to Pk are brought into contact with and separated from each other by moving the rolls R1 to R5 and T1*g* to T1*k* between the contact positions and the separation positions, the present invention is not limited thereto; for example, the effects of the present invention are also produced in a structure where the retracting rolls R1 to R5 are omitted, only the primary transfer rolls T1*g* and T1*m* are moved between the contact positions and the separation positions and the movement of the intermediate transfer belt B by the primary transfer rolls T1*g* to T1*m* and the movement of the charge removing sheet metals JB are synchronized with each other. That is, the primary transfer rolls T1*g* to T1*m* may be provided with the functions of the retracting rolls R1 to R5.

(H06) While in the above-described examples, the charge removing sheet metals JB are disposed out of contact with the intermediate transfer belt B, the present invention is not limited to this structure; for example, a structure may be adopted in which instead of the charge removing sheet metals JB, conductive nonwoven cloths or charge removing brushes as an example of the charge removing member are made in contact with the intermediate transfer belt B. In this case, structures similar to the links LN1 to LN4 are provided so that the movement of the intermediate transfer belt B and the movement of the conductive unwoven cloths or the charge removing brushes are synchronized with each other, and by a change of the pressing force of the conductive unwoven cloths or the charge removing brushes and separation, the conveyance resistance of the intermediate transfer belt B and the charge removing performance are prevented from changing.

(H07) In the first example, by providing, in addition to the separation-time stretching rolls Rta and Rtb, a similar separation-time stretching roll in one or more positions in order to reduce the generation of the tension lines shown in FIG. 10, the generation of the tension lines can be further reduced. While it is preferable to dispose a plurality of separation-time stretching rolls Rta and Rtb in correspondence with the positions where the tension lines are readily generated, that is, the positions where the free lengths are too long as in the first example, the present invention is not limited thereto; as in the second example, depending on the apparatus structure or the like, a structure may be adopted in which the separation-time stretching roll (Rta, Rtb) is disposed only in one position even when the belt module BM is capable of development of up to six colors.

(H08) While in the first example, it is preferable to dispose the stretching rolls (Rd, Rt, Rt2, Rt3, R1 to R5, T1*g* to T1*k*) so that the line segments L1 to L4 shown in FIG. 2 are linear, the present invention is not limited thereto; the effects of the present invention are also produced when the line segments L1 to L4 are not linear.

(H09) While in the first example, the line segments L1 to L4 extend in the right-to-left direction and in the inclination directions thereof in order to dispose the visible image forming members (UY+GY) to (UK+GK) for Y, M, C and K as horizontally as possible and in particular, the first line segment L1 extends horizontally, the present invention is not limited thereto; for example, the line segments L1 to L4 may extend in the top-to-bottom direction and in the inclination directions thereof in order to dispose the visible image forming members (UY+GY) to (UK+GK) for the colors so as to extend as vertically as possible. In this case, in particular, it is preferable that the first line segment L1 extends vertically.

(H010) While in the examples, the photoreceptor drums Py to Pc for the three colors are simultaneously separated from the intermediate transfer belt B by the link LN3 when the third retracting roll R3 is moved to the third separation position, the present invention is not limited thereto; for example, by providing separate retracting rolls and links corresponding to the photoreceptor drums Py to Pc for Y, M and C, the photoreceptor drums Py to Pc for the three colors can be structured either so as to be simultaneously separated from the intermediate transfer belt B or so as to be individually separated therefrom.

(H011) While in the examples, the photoreceptor drums Pg and Po for the spot colors are disposed on the upstream side in the Ya direction of the photoreceptor drums Py to Pk for Y, M, C and K, the present invention is not limited thereto; for example, they may be disposed on the downstream side in the Ya direction of the photoreceptor drum Pk for black or disposed between the photoreceptor drums Py to Pk for Y, M, C and K. Moreover, for example, a structure may be adopted in which only the photoreceptor drum Po for orange is disposed on the downstream side in the Ya direction of the photoreceptor drum Pk for black.

(H012) While in the first example, the following fourteen patterns shown in FIG. 5 are executed: a case where all of the six colors "GOYMCK" are used, cases where five colors "GYMCK" and "OYMCK" are used, respectively; cases where four colors "YMCK", "GYMC" and "OYMC" are used, respectively; a case where three colors "YMC" are used; cases where two colors "GO", "GK" and "OK" are used, respectively; cases where one color "G", "O" and "K" is used, respectively; and a case where "none" of the colors, that is, not a color is used, the present invention is not limited thereto; for example, two patterns of a case where five colors "GOYMC" are used and a case where three colors "GOK" are used may be added.

(H013) In the first example, the third angle β shown in FIG. 2 may be 0. That is, a structure may be adopted in which the photoreceptor drum Pg is disposed on the extension line of the second line segment L2 and the photoreceptor drums Pg and Po are disposed on the same line.

What is claimed is:

1. An intermediate transfer device comprising:

an endless-belt-form intermediate transfer material whose outer surface successively passes, in a rotation direction, through regions where the outer surface is opposed to a first image holding member that holds a first image and a second image holding member that holds a second image;

a first moving member that is disposed on a rear surface side of the intermediate transfer material and on a side of the first image holding member, and that is movable between a first position-1, where the first moving member applies tension to the intermediate transfer material, and a second position-1, which is farther from the intermediate transfer material than the first position-1;

a second moving member that is disposed on the rear surface side of the intermediate transfer material and on a side of the second image holding member, and that is movable between a first position-2, where the second moving member applies tension to the intermediate transfer material, and a second position-2, which is farther from the intermediate transfer material than the first position-2;

a first tension applying member that is disposed on an upstream side, in the rotation direction of the intermediate transfer material, of the first moving member and that applies tension to the intermediate transfer material;

a second tension applying member that is disposed on a downstream side, in the rotation direction of the intermediate transfer material, of the second moving member and that applies tension to the intermediate transfer material; and a third tension applying member that is disposed on the rear surface side of the intermediate transfer material, and that applies tension to the intermediate transfer material when at least either the first moving member is moved to the second position-1 or the second moving member is moved to the second position-2, and that is separated from the intermediate transfer material when the first moving member is in the first position-1 and the second moving member is in the first position-2.

2. The intermediate transfer device according to claim 1, further comprising:

a fourth tension applying member that is disposed on the rear surface side of the intermediate transfer material and between the first moving member and the third tension applying member in the rotation direction of the intermediate transfer material, and that applies tension to the intermediate transfer material.

3. The intermediate transfer device according to claim 1, wherein the third tension applying member is preliminarily disposed in an intersection point position which is a point of intersection of a first line segment, which connects the first tension applying member and the second moving member in the first position-2, and a second line segment, which connects the first moving member in the first position-1 and the second tension applying member.

4. The intermediate transfer device according to claim 1, comprising:

the intermediate transfer material whose outer surface successively passes, in the rotation direction, through regions where the outer surface is opposed to the first image holding member, the second image holding member and a third image holding member that holds a third image;

a third moving member that is disposed on the rear surface side of the intermediate transfer material and between the second moving member and the second tension applying member in the rotation direction of the intermediate transfer material and that is movable between a first position-3, where the third moving member apples tension to the intermediate transfer material, and a second position-3, which is farther from the intermediate transfer material than the first position-3; and the third tension applying member that applies tension to the intermediate transfer material between the first moving member and the third moving member in the rotation direction of the intermediate transfer material when the first moving member is moved to the first position-1, the second moving member is moved to the second position-2 and the third moving member is moved to the first position-3, and that applies tension to the intermediate transfer material between the first moving member and the second tension applying member in the rotation direction of the intermediate transfer material when the first moving member is moved to the first position-1, the second moving member is moved to the second position-2 and the third moving member is moved to the second position-3.

5. A transfer device comprising:

the intermediate transfer device according to claim 1, in which images held by respective image holding members are transferred onto the outer surface of the endless-belt-form intermediate transfer material, which is disposed so that the outer surface thereof is opposed to each of the image holding members, the image holding members including the first and second image holding members; and a final transfer member that transfers the images transferred onto the outer surface of the intermediate transfer material, onto a final transfer material.

6. An image forming apparatus comprising:

the transfer device according to claim 5, the transfer device including the image holding members in which respective latent images for respective images are formed on respective surfaces thereof, wherein the transfer device transfers each of the images on the surfaces of the image holding members onto a medium;

developing devices that develop the respective latent images on the respective surfaces of the respective image holding members, into respective images as visible images; and a fixing device that fixes the images on a surface of the medium.

* * * * *